US012247567B2

(12) United States Patent
Wagner

(10) Patent No.: US 12,247,567 B2
(45) Date of Patent: Mar. 11, 2025

(54) SCROLL COMPRESSOR WITH DIRECT RETURN OF OIL FROM AN OIL SEPARATOR INTO A COMPRESSION PORTION

(71) Applicant: SANDEN INTERNATIONAL (EUROPE) GMBH, Bad Nauheim (DE)

(72) Inventor: Manuel Wagner, Gosheim (DE)

(73) Assignee: Sanden International (Europe) GmbH, Bad Nauheim (DE)

( * ) Notice: Subject to any disclaimer, the term of this patent is extended or adjusted under 35 U.S.C. 154(b) by 0 days.

(21) Appl. No.: 18/262,803

(22) PCT Filed: Jan. 25, 2022

(86) PCT No.: PCT/EP2022/051608

§ 371 (c)(1),
(2) Date: Apr. 11, 2024

(87) PCT Pub. No.: WO2022/161941

PCT Pub. Date: Aug. 4, 2022

(65) Prior Publication Data

US 2025/0035114 A1 Jan. 30, 2025

(30) Foreign Application Priority Data

Jan. 26, 2021 (DE) ..... 10 2021 101 627.4

(51) Int. Cl.
*F04C 29/02* (2006.01)
*F04C 18/02* (2006.01)

(52) U.S. Cl.
CPC ..... *F04C 29/026* (2013.01); *F04C 18/0215* (2013.01); *F04C 18/0261* (2013.01); *F04C 29/028* (2013.01)

(58) Field of Classification Search
CPC ..... F04C 18/0207–0292; F04C 29/02–028
See application file for complete search history.

(56) References Cited

U.S. PATENT DOCUMENTS

2009/0191081 A1 7/2009 Lee et al.
2013/0251548 A1* 9/2013 Ohno ..... F04C 18/02 417/228
2015/0154025 A1 6/2015 Tanimura

FOREIGN PATENT DOCUMENTS

DE 10 2017 125 968 A1 5/2019
JP H1182351 A * 3/1999
(Continued)

OTHER PUBLICATIONS

European Patent Office, International Search Report issued in International Patent Application No. PCT/EP2022/051608, mailed May 17, 2022.

(Continued)

*Primary Examiner* — Mark A Laurenzi
*Assistant Examiner* — Xiaoting Hu
(74) *Attorney, Agent, or Firm* — Baker Botts L.L.P.

(57) ABSTRACT

The invention relates to a scroll compressor for compressing a fluid, comprising a compression section with an inlet for sucking the fluid into the compression section, an outlet for discharging the compressed fluid out of the compression section, a stationary disk having a stationary spiral, and an orbiting disk having an orbiting spiral. The orbiting disk is orbitable relative to the stationary disk to move the fluid from the inlet to the outlet and to compress it thereby. The scroll compressor comprises an oil separator for separating oil from the compressed fluid and a direct oil return for directly returning oil from the oil separator to the compression section, the direct oil return comprising at least one orifice opening. For enabling efficient operation, the direct oil return comprises an outgassing chamber arranged (Continued)

Figure 1:
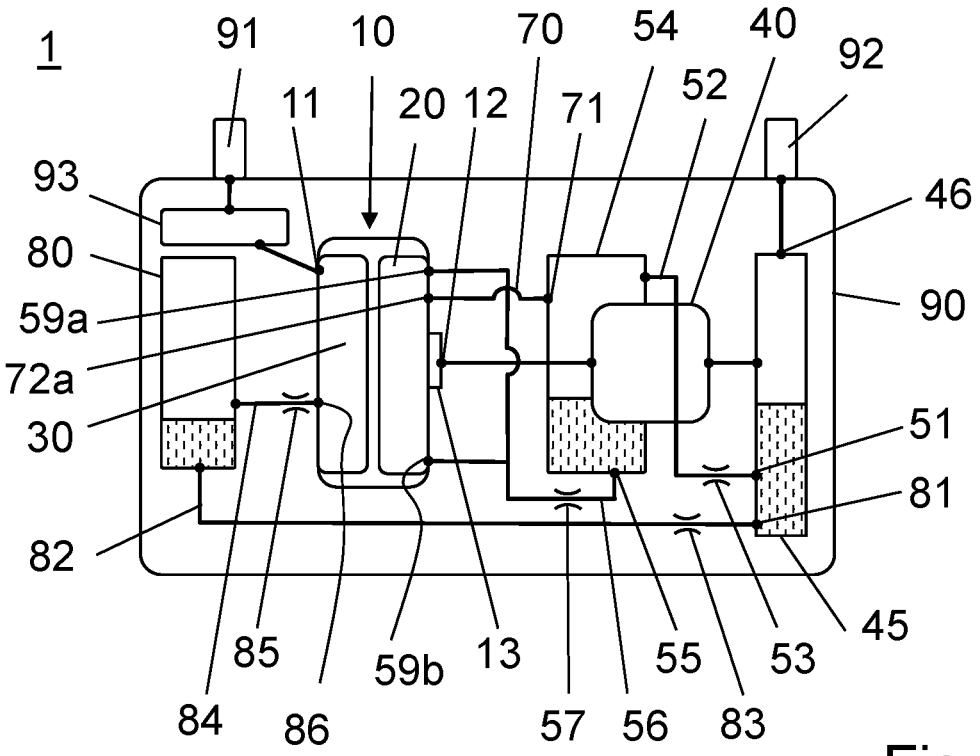

between the first flow valve and the orifice opening and a fluid return for returning fluid from the outgassing chamber to the compression section.

20 Claims, 4 Drawing Sheets

(56) References Cited

FOREIGN PATENT DOCUMENTS

| | | | | | |
|---|---|---|---|---|---|
| JP | 2006283605 | A | * | 10/2006 | ..... F04C 18/0276 |
| JP | 2008088945 | A | * | 4/2008 | |
| JP | 2008196415 | A | * | 8/2008 | |
| JP | 2015-106377 | A | | 6/2015 | |
| JP | 2017-106377 | A | | 6/2017 | |
| WO | 2020/011769 | A2 | | 1/2020 | |

OTHER PUBLICATIONS

Japan Patent Office, Notice of Reasons for Rejection issued in Japanese Patent Application No. 2023-545261, dated Jul. 24, 2024.

* cited by examiner

SCROLL COMPRESSOR WITH DIRECT RETURN OF OIL FROM AN OIL SEPARATOR INTO A COMPRESSION PORTION

CROSS-REFERENCE TO RELATED APPLICATIONS

This application is a U.S. National Stage Patent Application under 37 U.S.C. § 371 of International Patent Application No. PCT/EP2022/051608, filed on Jan. 25, 2022, which claims the benefit of German Patent Application No. 10 2021 101 627.4, filed on Jan. 26, 2021, the disclosures of each of which are incorporated herein by reference in their entirety.

The invention relates to a scroll compressor for compressing a fluid with a compression section, which has an inlet of the compression section for sucking the fluid into the compression section, an outlet of the compression section for discharging the compressed fluid from the compression section, a stationary disk with a stationary spiral, and an orbiting disk with an orbiting spiral.

Scroll compressors are used, for example, as compressors in air conditioning systems, especially in air conditioning systems for motor vehicles. Furthermore, they are used as heat pumps. Compared with other types of compressors, they are characterized by particularly uniform, low-vibration and quiet operation.

The compression section forms the core of the scroll compressor. As the orbiting disk orbits relative to the stationary disk, the fluid-in particular a gas or gas mixture-is compressed. For this purpose, the orbiting spiral and the stationary spiral are interleaved in such a way that they form compression chambers for the fluid between them. In relation to the stationary spiral, each compression chamber with the fluid enclosed therein moves from an outer region of the stationary spiral to its center. In the process, the space available for the fluid becomes progressively smaller and the fluid is compressed.

In operation, a maximum pressure of the fluid is reached at the outlet of the compression section. The fluid enters the compression section at an intake pressure and is expelled from it at a significantly higher outlet pressure.

The fluid, which is increasingly compressed between the orbiting disk and the stationary disk, pushes the orbiting disk and the stationary disk apart. A lifting force therefore acts on the orbiting disk. The strength of the lift-off force depends in particular on the intake pressure, the outlet pressure and the geometry of the compression section. Typically, a change in outlet pressure has a more significant effect on the downforce than a change in intake pressure.

To achieve high compression, the compression chambers formed by the interlocking of the stationary disk and the orbiting disk and shifted toward the center must be sufficiently tightly sealed. To ensure that the orbiting disk is pressed firmly and tightly onto the stationary disk and that no fluid escapes from the compression section, the orbiting disk is subjected to a contact pressure on its rear side opposite the stationary disk. For this purpose, a contact pressure chamber is provided on the rear side of the orbiting disk. The contact pressure presses the orbiting disk with a contact force in the direction of the stationary disk.

The engagement of the orbiting spiral with the stationary disk and the engagement of the stationary spiral with the orbiting disk provide friction during operation. Electrically driven scroll compressors typically operate in a speed range of 500 to 12000 $min^{-1}$. A high friction is noticeable through reduced efficiency.

Oil is fed into the contact pressure chamber to lubricate the orbiting disk. Furthermore, an oil supply line can be formed from the contact pressure chamber through the orbital disc. Through the oil supply line, oil can flow from the contact pressure chamber between the stationary disk and the orbiting disk.

There should be as little oil as possible in the fluid discharged from the scroll compressor. An excessive amount of oil in the discharged fluid can lead to reduced efficiency of downstream components to which the discharged fluid flows on. For example, the efficiency of a refrigerant circuit may deteriorate as the admixture of oil increases.

Typically, in a refrigeration circuit, the scroll compressor is the only component that requires oil within the refrigeration circuit itself for lubrication of mechanically stressed parts. In general, a refrigeration circuit can be operated in different operating conditions. The efficiency of the refrigeration circuit is largely dependent on its operating condition. For example, an excessive amount of oil can cause surfaces inside heat exchangers to be wetted with oil. This reduces a heat transfer coefficient in the respective heat exchanger. Consequently, the efficiencies of the evaporator and condenser decrease. As a result, the refrigerant circuit as a whole must be operated at a higher pressure ratio in order to provide the required refrigeration capacity. An excessive amount of oil thus reduces the overall efficiency and increases the stress on the mechanical components within the scroll compressor due to the increased pressure ratio.

Therefore, the compressed fluid is passed through an oil separator after the compression section. The oil separator separates the oil at least partially from the compressed fluid. The separated oil is returned to the contact pressure chamber via a (second) oil return.

During operation of the scroll compressor, the oil in the contact pressure chamber is subject to contact pressure. An orifice opening of the oil supply line is positioned in a central portion of a compressor channel of the orbiting disk, which is formed by the orbiting spiral on the orbiting disk. Due to this positioning and a continuous mass flow of a mixture of oil and refrigerant coming from a high pressure side, a contact pressure at an intermediate pressure level is established in the contact pressure chamber. The contact pressure pushes the orbiting disk with a contact force in the direction of the stationary disk. The positioning in the central portion is largely responsible for ensuring that the desired and sufficiently high contact pressure is achieved. The contact pressure is variable and depends on the operating pressures. This ensures a seal between the stationary disk and the orbiting disk at all operating points and keeps friction as low as possible.

However, due to this positioning of the orifice opening of the oil supply line, the radially outer areas between the stationary disk and the orbiting disk are not optimally supplied with oil. This results in increased friction, impaired efficiency and, under certain circumstances, a shorter service life of the scroll compressor.

The object of the present invention can therefore be regarded as to create a scroll compressor that enables more efficient operation and has higher reliability.

The above problem is solved by a scroll compressor for compressing a fluid.

The scroll compressor for compressing a fluid comprises:

a compression section with an inlet of the compression section for sucking the fluid into the compression section, an outlet of the compression section for discharging the compressed fluid out of the compression section, a stationary disk having a stationary spiral, and an orbiting disk having an orbiting spiral, the orbiting disk being orbitable relative to the stationary disk along a compression direction to move the fluid from the inlet of the compression section to the outlet of the compression section, thereby compressing the fluid; and an oil separator for separating oil from the compressed fluid;

wherein the scroll compressor additionally comprises a direct oil return for directly returning oil from the oil separator to the compression section, the direct oil return comprising at least one orifice opening.

The direct oil return continuously returns oil from the oil separator to the compression section during operation. This reduces friction in the compression section. Thus, the direct oil return enables efficient operation of the scroll compressor. In addition, wear in the compression section is reduced. This increases the reliability and service life of the scroll compressor.

In operation, the oil separator is (at least substantially) subjected to the outlet pressure. The invention takes advantage of a difference between the pressure in the oil separator and the pressure of the fluid at the orifice opening to directly and selectively return the oil from the oil separator to the compression section. A key advantage is that the oil flow through the direct oil return is driven by a pressure ratio of the outlet pressure to the intake pressure. The amount of oil recirculated depends largely on this pressure ratio. For example, this quantity is the same for an intake pressure of 3 bar and an outlet pressure of 15 bar at a speed of 600 $min^{-1}$ as it is for an intake pressure of 3 bar, an outlet pressure of 15 bar but a speed of 8500 $min^{-1}$.

The amount of oil returned by the direct oil return is (at least substantially) independent of the speed of the scroll compressor and (at least substantially) independent of the exact outlet pressure. Even at low speeds, the direct oil return returns a sufficient amount of oil to the compression section. The direct oil return and is thus suitable for lubrication of the compression section in a wide variety of load conditions of the scroll compressor. In particular, it improves lubrication at low speeds.

Furthermore, the direct oil return works independently of the contact pressure. Even if the contact pressure drops, the direct oil return continues to return oil to the compression section as long as the outlet pressure remains sufficiently high.

In addition, the oil is better retained in the scroll compressor. The inlet section no longer needs to be supplied by oil creeping past from a contact pressure chamber into the compression section or passing through an external part of a refrigerant circuit to the inlet of the compression unit. The external part of the refrigerant circuit is understood to be those parts of the refrigerant circuit that are outside the scroll compressor. The fluid downstream of the oil separator contains less oil. Less oil is passed through the external part of the refrigerant circuit. Typically, a higher percentage of oil in the fluid in an external part of the refrigerant circuit provides poorer thermodynamic properties of the refrigerant-oil mixture.

The proposed direct oil return significantly reduces an oil circulation ratio (OCR) of the refrigerant circuit. The direct oil feed brings the oil precisely to an inlet area of the compression unit. This improves the efficiency of the refrigerant circuit.

Particularly at low speeds, in conventional scroll compressors there is an increased risk of oil unintentionally remaining in the external part of the refrigerant circuit due to the low mass flow of the refrigerant through the external part of the refrigerant circuit.

Conversely, the proportion of oil that is available for lubrication during operation within the scroll compressor and in particular within the compression section is increased. The active, direct oil return reduces the total amount of oil required to operate the scroll compressor. This lowers costs and reduces the weight of the refrigerant circuit. As a result, for example, the efficiency of a vehicle in which the scroll compressor is incorporated increases.

The outlet of the compression unit is arranged at least substantially in a center of the stationary disk. In particular, outlet of the compression unit may be arranged exactly in the center of the stationary disk.

The stationary spiral forms a spiral compressor channel (of the stationary disc) extending from an outer end of the stationary spiral to an inner end of the stationary spiral. The inner end of the stationary spiral is located at a center of the stationary spiral. It is located at an outlet opening of the stationary disk. The outlet of the compression section includes this outlet opening. In particular, this outlet opening may form the outlet of the compression section.

The stationary spiral may be disposed on a stationary base of the stationary disk. The stationary spiral may be formed of a wall extending parallel to a center axis of the stationary disk from the stationary base. Preferably, an end face of the stationary spiral facing away from the stationary base along this central axis is flat and parallel to the stationary base.

The outlet opening may comprise a hole in the stationary base. In particular, the outlet opening may be formed as a hole in the stationary base.

Similarly, the orbiting disk forms a spiral compressor channel of the orbiting disk extending from an outer end of the orbiting disk to an inner end of the orbiting disk. In this disclosure and in the claims, the term "compressor channel" without further addition refers only to the compressor channel of the stationary disk unless otherwise explicitly stated and unless the context necessarily indicates otherwise.

The orbiting spiral may be disposed on an orbiting base of the orbiting disk. The orbiting spiral may be formed of a wall extending away from the orbiting base in a direction parallel to a central axis of the orbiting disk. Preferably, an end face of the orbiting spiral facing away from the orbiting base along this central axis (of the orbiting disk) is formed flat and parallel to the orbiting base. The orbiting base may be parallel to the stationary base.

The stationary spiral and the orbiting spiral may each have exactly one spiral arm.

The scroll compressor includes an orbiting mechanism for orbiting the orbiting disk relative to the stationary disk. During orbiting, the orbiting disk is eccentrically displaced relative to the stationary disk along an at least substantially circular path. Preferably, the center axis of the orbiting disk is moved circularly about the center axis of the stationary disk. The center axis of the stationary disk may be perpendicular to the stationary base surface. It may extend through a center of the stationary disk and/or a center of the stationary spiral. In particular, the center of the stationary spiral may form the center of the stationary disk and vice versa.

In operation (compressor operation), at least one compression chamber is formed between the orbiting spiral and the stationary spiral. The sucked-in fluid is trapped in the compression chamber, compressed in the compression chamber, moved toward the outlet opening of the stationary disk, and finally forced into this outlet opening.

An intake portion of the compressor channel is composed of all portions of the compressor channel that are at least temporarily in direct fluid communication with the inlet of the compression section when the orbiting disk orbits relative to the stationary disk along the compression direction. An outlet region of the compressor channel is composed of all portions of the compressor channel that are at least temporarily in direct fluid communication with the outlet of the compression section when the orbiting disk orbits relative to the stationary disk along the compression direction. A central portion of the compressor channel is composed of all portions of the compressor channel that cannot be in direct fluid communication with either the inlet of the compression section or the outlet of the compression section. These definitions apply to both the stationary disk compressor channel and the orbiting disk compressor channel.

For the purposes of this application, an innermost turn or first turn of a respective spiral means a region of that spiral which extends from its inner end to the point at which it once wraps around its center.

A position angle of 0° is assigned to the inner end of the stationary spiral. The position angle increases continuously up to the outer end of the stationary spiral along the extension of the stationary spiral. A spiral angle of the stationary spiral is given by its outer end. The spiral angle thus corresponds to the largest position angle of the stationary spiral.

This is explained as an example for a stationary spiral with two turns: The first turn of the stationary spiral starts with the inner end of the stationary spiral at a position angle of 0° and ends at a position angle of 360°. The second and outermost turn starts at a position angle of 360° and ends with the outer end of the stationary spiral at a spiral angle of 720°.

Accordingly, position angles are defined in the compressor channel. An outer end of the spiral compressor channel is defined by an inlet opening of the compressor channel, which is formed between the outer end of the stationary spiral and an inner beginning of the outermost turn of the stationary spiral.

For the purposes of this application, an outer side of a portion of a respective spiral is a side of that portion of the spiral opposite to the center of the spiral in the radial direction. Accordingly, an inner side of said portion of the spiral is a side of said portion of the spiral facing the center of the spiral in the radial direction.

The compression section may form inner-side-guided compression chambers and outer-side-guided compression chambers. An inner-side-guided compression chamber is formed and guided along the outer side of the stationary spiral. An outer-side-guided compression chamber is formed and guided along the inner side of the stationary spiral.

At this point, it should be emphasized that the definitions regarding the compressor channel is independent of the definition of the compression chamber. In particular, the compression chamber need not be completely within the compressor channel of the stationary disk at all times. For example, the compression chamber can be formed by having the outer end of the orbiting spiral contact an outer side of the outermost turn of the stationary spiral. This sealing closes and seals an inner-side-guided compression chamber. The newly formed, inner-side-guided compression chamber may still be (partially) outside the compressor channel of the stationary disk at this point. An outer-side-guided compression chamber, on the other hand, is closed by an outer side of the orbiting spiral coming into contact with the outer end of the stationary spiral. At this point, the newly formed, outer-side-guided compression chamber is already completely inside the compressor channel. It is guided on an outer side of the compressor channel. In other words, the outer side of the compressor channel is formed by the inner side of the stationary spiral.

In operation, there is an intake pressure at the inlet of the compression section and an outlet pressure at the outlet of the compression section. Preferably, the intake pressure in operation is in the range of 1 bar to 7 bar. Alternatively or additionally, the outlet pressure in operation is in the range of 8 bar to 32 bar. The exact intake pressure and outlet pressure can differ depending on the fluid used and the exact operating condition.

The intake pressure and outlet pressure can be determined in operation by a system connected to the scroll compressor, through which the fluid compressed in the scroll compressor flows. Such a system may be, for example, a heat exchanger of an air conditioning system.

A maximum outlet pressure of the scroll compressor results from the geometry of the compression section and the respective intake pressure. In addition, a dead volume of the outlet opening of the stationary disk (outlet bore) can influence the maximum outlet pressure. The higher the intake pressure, the higher the maximum outlet pressure. At a given intake pressure, the maximum outlet pressure results from the geometry-related compression of the fluid that can be achieved in the compression section using the known fluid equations, for example the equation for ideal gases or the Van-der-Waals-equation. The (actual) outlet pressure is usually lower than the maximum outlet pressure.

The inlet of the compression section may comprise several subsections. In particular, the inlet can have a first inlet subregion through which the radially inwardly guided compression chambers are supplied with fluid, and a second inlet subregion through which radially outwardly guided compression chambers are supplied with fluid. The subregions can be spatially separated from one another, for example in a radially outer region of the compression section on two opposite sides.

The direct oil return is used for the immediate, direct return of oil from the oil separator directly into the compression section. The direct oil return extends from the oil separator directly to the compression section.

In operation, oil is forced by pressure from the oil separator into the direct oil return. This oil flows along a flow direction of the oil through the direct oil return and exits the orifice opening of the direct oil return into the compression section. The oil thus recirculated serves to lubricate the compression section.

In a preferred embodiment of the invention, the orifice opening (of the direct oil return) is arranged in an inlet region of the compression section which, in operation, is at least partially in direct fluid communication with the inlet of the compression section. This ensures particularly good lubrication also in the radially outer regions of the orbiting spiral and the stationary spiral.

Depending on the exact positioning of the orifice opening, it is possible, for example, for the orifice opening to be temporarily swept and covered by the orbiting spiral during operation. At this time, the orifice opening is then not in direct fluid communication with the inlet. It is also possible that the orifice opening is in direct fluid communication with the inlet during a complete revolution of the orbiting disk in a first time period, is swept by the orbiting spiral in a second time period, is in communication with a compression chamber in a third time period, and is swept again by the orbiting spiral in a fourth time period.

In a particularly preferred embodiment, the orifice opening is not swept by the compression chamber (or any of the plurality of compression chambers) at any time.

Alternatively or additionally, the orifice opening is particularly preferably swept exactly once by the orbiting spiral during a complete revolution of the orbiting spiral.

The orifice opening of the direct oil return is preferably arranged in the stationary disk. This reduces the complexity and simplifies the manufacture of the direct oil return. In particular, the orifice opening may be arranged entirely in the stationary base. Alternatively, the orifice opening may be arranged entirely or partially in the inner side or outer side of the stationary spiral. Such variants are more difficult to manufacture. On the other hand, lubrication on the inner side or outer side of the stationary spiral can be further improved.

In a particularly preferred embodiment, the orifice opening of the direct oil return is arranged in the intake portion of the compressor channel (of the stationary spiral), which in operation is at least temporarily in direct fluid communication with the inlet of the compression section, and/or is arranged outside the compressor channel. When the orifice opening is arranged at the outer end of the compressor channel, a first portion of the orifice opening may be arranged in the compressor channel and a second portion of the orifice opening may be arranged outside the compressor channel.

According to another aspect, the direct oil return orifice opening is preferably arranged at a position angle in a range of $\gamma-30°$ and $\gamma+30°$, where $\gamma$ is a position angle of the outer end of the compressor channel. The orifice opening in this case may further be disposed at a radial distance RM,1 from the center of the stationary disk, where $R_{M,1}$ is in a range between $(R_I(\gamma)\ B_K)$ and $R_I(\gamma)$, where $R_I(\gamma)$ is a radial distance of the inner side of the stationary spiral at the outer end of the compressor channel (i.e., at the outer end of the stationary spiral) and $B_K$ is a width of the compressor channel in the radial direction at the outer end of the compressor channel. Thus, in this case, the orifice opening is located near the outer end (upstream end) of the compressor channel. The orifice opening is then swept at least once by the face of the orbiting spiral during one revolution. This distributes the oil emerging from the orifice opening particularly well. In particular, $R_{M,1}$ can lie in a range between $(R_I(\gamma)-B_K/2)$ and $R_I(\gamma)$. An orifice opening designed in this way contributes particularly well to lubrication in the region of outer-side-guided compression chambers.

Alternatively, the orifice opening of the direct oil return is preferably located outside the stationary spiral and at a position angle ranging from $\theta-30°$ to $\theta+30°$; where $\theta=\gamma+180°$. The orifice opening in this case may further be disposed at a radial distance $R_{M,2}$ from the center of the stationary spiral, where $R_{M,2}$ is in a range from $R_A(\theta-360°)$ to $R_A(\theta-360°)+B_K$, where $R_A(\theta-360°)$ is a radial distance of the outer side of the stationary spiral at the position angle $\theta-360°$. Thus, in this embodiment, the orifice opening is located outside the stationary spiral and with respect to the center of the stationary spiral at a position opposite to the outer end of the compressor channel. As a result, the oil emerging from the orifice opening is particularly well distributed. In particular, $R_{M,2}$ may lie in a range between $R_A(\theta-360°)$ and $R_A(\theta-360°)+B_K/2$. An orifice opening designed in this way contributes particularly well to lubrication in the region of the inner-side-guided compression chambers.

Particularly preferably, a plurality of orifice openings is formed, wherein at least one of the plurality of orifice openings is formed according to one of the embodiments according to the penultimate aspect and at least one of the plurality of orifice openings is formed according to one of the embodiments according to the aspect described last. The advantages apply accordingly in each case.

In an advantageous embodiment of the invention, the direct oil return comprises a first flow valve. The first flow valve is preferably arranged (as seen along the direction of flow of the oil in the direct oil return) between a first oil inlet of the direct oil return and the orifice opening. However, the first flow valve can generally also be arranged directly at the first oil inlet or at the orifice opening. In particular, the first flow valve may be formed by the first oil inlet and/or the second orifice opening itself. The first flow valve reduces the mass flow of oil (possibly with fluid dissolved therein), which is returned by the direct oil return.

Particularly preferably, the first flow valve is designed as a throttle valve.

In this application, a throttle valve is preferably understood as an element that generates a pressure difference between the valve inlet and outlet. Particularly preferably, it may be an unregulated throttle valve. For example, it can be an orifice or nozzle. This allows a simple, cost-effective and reliable implementation.

The first flow valve is configured to reduce the mass flow of oil (together with any fluid dissolved in it) from the oil separator. In this way, a pressure in the direct oil return downstream of the first flow valve (for example, an intermediate pressure described further below and/or an orifice pressure described further below) can be influenced in a simple manner.

In a particularly preferred embodiment, the direct oil return comprises the first flow valve and an outgassing chamber arranged (as viewed along the intended flow direction of the oil in the direct oil return) between the first flow valve and the orifice opening of the direct oil return. In other words, the outgassing chamber is located downstream of the first flow valve and upstream of the orifice opening.

During operation the direct oil return continuously removes oil from the oil separator and stores excess oil in the outgassing chamber. The outgassing chamber is located in the scroll compressor. By continuously drawing oil from the oil separator, for example at or near a bottom of the oil separator, and actively storing the oil temporarily, the efficiency of the separation process is maximized. The amount of oil leaving the compressor and entering an external refrigerant circuit is minimized.

As mentioned before, especially at low speeds, due to the low mass flow of the refrigerant, there is an increased risk that oil discharged from the scroll compressor into the external part of the refrigerant circuit may unintentionally remain in the external part of the refrigerant circuit. Even in such a case, the oil from the outgassing chamber continues to supply oil to the scroll compressor until the system is back in equilibrium. If an operating point then changes to a high load point, the oil previously trapped in the external part of the refrigerant circuit is carried back into the scroll compressor by the high mass flow of the refrigerant and is collected and temporarily stored in the scroll compressor again. In this way, the system is self-adjusting: It takes in or releases oil as needed.

In operation, the oil separator is (at least substantially) pressurized with the outlet pressure. As a result, there is a high solubility for the fluid in the liquid oil in the oil separator. The first flow valve reduces the mass flow of oil (along with any fluid dissolved therein) from the oil separator. This helps to ensure that the intermediate pressure in the outgassing chamber settles at a lower value than the outlet pressure. This also reduces the solubility for the fluid in the oil. Downstream of the first flow valve, the oil may be oversaturated with fluid. In the outgassing chamber, the oversaturation fraction of the fluid in the oil can separate (at least partially) from the oil in a controlled manner. This reduces the risk of uncontrolled, severe formation of bubbles of the fluid in the oil downstream of the outgassing chamber. When the oversaturation fraction of the fluid is completely separated from the oil, there is at most just as much fluid in the oil as can be dissolved in the oil at equilibrium under the given conditions (saturation fraction of the fluid in the oil).

A first fluid connection of the direct oil return leads from the oil separator to the outgassing chamber. The first flow valve can be arranged in this first fluid connection. From the outgassing chamber, a second fluid connection of the direct oil return leads to the orifice opening.

Preferably, the scroll compressor is arranged so that (in operation) an intermediate pressure in the outgassing chamber is in a range of 0.2 bar to 6 bar above the intake pressure (of the compression section or scroll compressor), exceptionally preferably in a range of 0.3 bar to 5 bar above the intake pressure. The exact intermediate pressure can be influenced, for example, by the first throttle valve and/or by a fluid return, which will be described further below.

This ensures that enough oil exits the orifice opening of the direct oil return. It also ensures that no fluid flows through the direct oil return in the direction opposite to the direction of flow of the oil in the direct oil return. A too high pressure difference between the intermediate pressure and the intake pressure could result in too much oil flowing from the outgassing chamber into the compressing section.

Alternatively or additionally, the scroll compressor is preferably arranged so that the intermediate pressure in the outgassing chamber is at least 106% of the intake pressure during operation.

Thereby, absolute values of the intake pressure may be different for different operating conditions, and absolute values of the intermediate pressure may be different for different operating conditions. The ratio between intermediate pressure and intake pressure may also be different for different operating conditions. However, the ratio should be at least 1.06 for all (proper) operating conditions in each case.

Particularly preferably, the outgassing chamber has a volume in the range from 30 $cm^3$ to 150 $cm^3$, very preferably in the range from 50 $cm^3$ to 90 $cm^3$. As a result, the oil remains in the outgassing chamber for a long enough average time that at least a significant portion of the oversaturation fraction of the fluid evaporates during this time. On the other hand, the intermediate chamber is so compact that it requires little space and can be integrated with ease.

In a highly preferred further embodiment, the direct oil return comprises a second flow valve arranged after the outgassing chamber (as viewed along the direction of flow of the oil in the direct oil return). In particular, the second flow valve may be arranged in the second fluid connection, i.e. downstream of the outgassing chamber and upstream of the orifice opening of the direct oil return. In particular, the second flow valve may be a throttle valve. As previously defined, the throttle valve may be, for example, an orifice or nozzle. It is possible that the second flow valve is formed integrally with the orifice and/or an oil inlet of the second fluid connection at the outgassing chamber. The second flow valve serves to limit a mass flow of the oil from the outgassing chamber. This allows the orifice pressure of the oil at the orifice opening to be influenced in a simple and reliable manner.

If the direct oil return has several orifice openings, the direct oil return (in relation to the direction of flow of the oil in the direct oil return) preferably branches downstream of the outgassing chamber. Thus, only one intake chamber is required for the multiple orifice openings. This simplifies the design and manufacture of the scroll compressor and reduces its cost. It is also possible to have several second fluid connections leading directly from the outgassing chamber.

It is extremely advantageous if the direct oil return (or the second fluid connection) branches downstream of the second flow valve. Thus, only one common second flow valve is required for the multiple orifice openings of the same direct oil return. This further reduces design and manufacturing costs. In addition, the same orifice pressure is then applied to the multiple orifice openings (at least essentially).

Alternatively, different second flow valves can be provided for different orifice openings. This allows the orifice pressure to be set differently for different orifice openings.

In a particularly preferred embodiment, the scroll compressor has a fluid return of fluid from the outgassing chamber to the compression section. In this way, the fluid that has been separated from the oil in the outlet chamber can be returned to the fluid circuit.

Preferably, the orifice opening of the fluid return is arranged in the compression channel of the stationary disk. The orifice opening can, for example, be formed as a hole in the stationary base. At least part of the fluid return can be formed in the stationary disk. This reduces complexity and manufacturing costs.

Very preferably, the orifice opening of the fluid return is located in the central area of the compressor channel (of the stationary disk). This ensures that no fluid can flow out of the orifice opening of the fluid return upstream from the inlet of the compression section. At the same time, it is ensured that the orifice opening of the fluid return does not come into direct fluid communication with the outlet opening of the stationary spiral. This ensures high efficiency and effectiveness of the scroll compressor.

The fluid return may include a check valve. The check valve prevents fluid from a compression chamber, that sweeps the orifice of the fluid return, from flowing into the outgassing chamber. Alternatively or additionally, the fluid return may include a flow valve. This makes it easier to selectively set the intermediate pressure in the outgassing chamber higher than an average value of the pressure of the fluid (in the compressor channel) at the orifice opening of the fluid return.

In another embodiment, fluid can flow (at least substantially) unobstructed between the outgassing chamber and the orifice opening of the second fluid connection. That is, the second fluid return has neither a check valve nor a flow valve. Then, the intermediate pressure in the intake chamber is particularly directly influenced by the time-averaged value of the fluid at the orifice opening of the fluid return.

According to a further aspect, the orifice opening of the fluid return is very preferably arranged at a position in the compressor channel at which a time-average value of the pressure of the fluid in the compressor channel during operation is in a range from 104% to 170% of the intake pressure, in a further aspect in a range from 105% to 150%.

If, in an idealized consideration, the mass flows of the recirculated oil and fluid are left out of account, the intermediate pressure in the exhaust gas chamber is exactly the time-average value of the pressure of the fluid at the orifice of the fluid return. In fact, the intermediate pressure in operation is higher than the time average of the pressure of the fluid at the orifice opening of the fluid return due to the mass flows of the recirculated oil and fluid. This pressure differential causes fluid to flow from the outgassing chamber through the fluid return into the compression section. The pressure differential is maintained by feeding new oil from the oil separator into the outgassing chamber along with the fluid dissolved therein. However, the intermediate pressure is decisively influenced by the time-average value of the pressure of the fluid at the orifice opening of the fluid return.

The relationship between the time-averaged value of the fluid at the fluid return orifice and the intake pressure depends essentially on the geometry of the compression section and the exact position of the fluid return orifice in the compressor channel. Even for different operating conditions, it remains essentially constant-given the position of the orifice. On the other hand, the ratio can be controlled specifically by shifting the position of the orifice opening. The embodiment described therefore represents a particularly simple, reliable approach to selectively influencing the intermediate pressure that is suitable for a wide range of operating conditions.

The absolute values of the intake pressure can be different for different operating conditions and the absolute values of this time average can be different for different operating conditions. Also, the ratio between the intake pressure and this time average of the pressure of the fluid at the orifice opening of the fluid return may be different for different operating conditions. However, the ratio should be within the stated range for all (proper) operating conditions.

The described adjustment of the ratio provides an advantageous intermediate pressure in the outgassing chamber, for example according to one of the advantageous embodiments described elsewhere. The intermediate pressure is high enough that sufficiently enough oil flows from the outgassing chamber to the (at least one) orifice opening of the direct oil return, exits there and enters the compression section. On the other hand, the intermediate pressure is low enough that no excessive amounts of oil flow out of the outgassing chamber and that at least a substantial portion of the fluid dissolved in the oil supplied to the outgassing chamber separates from the oil in the outgassing chamber.

The determination of the ratio of the time average of the pressure of the fluid (in the compressor channel) at the orifice opening to the intake pressure may, for example, be based on a calculation and/or measurement of the pressure of the fluid in the compressor channel at the position of the orifice opening averaged over one circulation at a given intake pressure. The determination may also be based on measurement and/or calculation of a compression ratio averaged over one circulation of the fluid in the compressor channel at the orifice opening of the fluid return.

Time ranges (or ranges of revolution angles) in which the orifice of the fluid return is closed by the orbiting spiral can be disregarded for the calculation of the time average value of the pressure of the fluid at the orifice of the fluid return.

The absolute values of the intake pressure may be different for different operating conditions. Absolute values of this time average of the pressure of the fluid at the orifice opening of the fluid return can be different for different operating conditions. The relationship between the intake pressure and this time average value may also be different for different operating conditions. However, for all (proper) operating states, the time-average value should in each case lie in the aforementioned range of 104% to 170%, in the further development of 105% to 150% of the intake pressure in the respective operating state.

Most preferably, the orifice opening of the fluid opening is arranged outside the outlet portion of the compressor channel. This ensures that the orifice opening of the fluid return is not subjected to the outlet pressure from the fluid at any time. In a further development, the orifice opening is arranged in the compressor channel in such a way that at no time is it in direct fluid communication with a last-stage compression chamber. Otherwise, an undesirably high intermediate pressure could develop in the outgassing chamber.

According to a further aspect, the fluid return orifice opening is most preferably located at a position angle $\varepsilon$ in the compressor channel, where $\varepsilon$ is in a range from $\gamma-300°$ to $\gamma$ and where $\gamma$ is the position angle of the outer end of the compressor channel.

Exceptionally preferably, the orifice opening of the fluid return is arranged at a position angle $\varepsilon_1$ in the compressor channel, where $\varepsilon_1$ is in a range of $\gamma-300°$ to $\gamma-180°$. The orifice opening may be arranged such that it is swept only by outer-side-guided compression chambers and is closed exactly once per revolution by the orbiting spiral. For example, in this case, the sum of a distance of the orifice opening from the outer side of the compressor channel at this position angle and a width of the orifice opening in the radial direction may be smaller than a width of the spiral arm of the orbiting spiral in the radial direction at the corresponding position angle of the orbiting spiral.

Alternatively, the orifice opening of the fluid return is exceptionally preferably disposed at a position angle $\varepsilon_2$ in the compressor channel, where $\varepsilon_2$ is in a range of $\gamma-120°$ to $\gamma$. The orifice opening may be arranged such that it is swept only by inner-side-guided compression chambers and is closed exactly once per revolution by the orbiting spiral. For example, in this case, the sum of a distance of the orifice opening from the inner side of the compressor channel at this position angle and a width of the orifice opening in the radial direction may be smaller than a width of the spiral arm of the orbiting spiral in the radial direction at the corresponding position angle of the orbiting spiral.

Particularly preferably, the orifice opening of the fluid return is positioned such that it is in direct fluid communication with the inlet of the compression section (the intake pressure) for a maximum total of 130° out of 360° of the revolution angle of the orbiting disk per revolution. Alternatively or additionally, the orifice opening of the fluid return is particularly preferably closed by the orbiting spiral for a maximum total of 130° of 360° of the revolution angle of the orbiting disk per revolution. Thus, the time-averaged pressure of the fluid at the orifice opening of the fluid return and the intermediate pressure become sufficiently high enough for good delivery of oil from the outgassing chamber into the compression section.

According to a further aspect of the scroll compressor, it is highly preferred that in operation the intermediate pressure is at least 0.1 bar above the time average of the pressure of the fluid (in the compressor channel) at the orifice of the fluid return. Due to the pressure difference, fluid released in the outgassing chamber flows through the fluid return back into the compression section.

Alternatively or additionally, the scroll compressor is very preferably arranged so that the intermediate pressure in operation is less than 2 bar above the time average of the pressure of the fluid (in the compressor channel) at the orifice opening of the fluid return. If the intermediate pressure is very high, less of the fluid dissolved in the oil will convert back to the gas phase in the outgassing chamber. In addition, too high an intermediate pressure can result in excessive oil flow from the outgassing chamber to the orifice opening of the direct oil return. It has been previously explained that the intermediate pressure and a difference between the intermediate pressure and the time average of the pressure of the fluid at the orifice opening of the fluid return can be easily and specifically influenced by the exact positioning of this orifice opening.

For example, the intermediate pressure in operation can be in a range of 0.2 bar to 1.5 bar above the time-average value of the pressure of the fluid (in the compressor chamber) at the position of the orifice opening of the fluid return.

Very preferably, an inlet of the fluid return in the outgassing chamber is arranged above the oil inlet of the second fluid connection of the direct oil return. Thus, only separated fluid flows into the fluid return; correspondingly, liquid oil flows into the second fluid connection of the direct oil return. "Above" in this context means that the inlet of the fluid return, as viewed along a direction of a gravitational force, opens upstream of (i.e., over) the oil inlet of the second fluid connection of the direct oil return into the outgassing chamber when the scroll compressor is positioned relative to a direction of a gravitational force in a desired operating position. In particular, the inlet of the fluid return may be located at an upper end of the outgassing chamber and/or the inlet of the second fluid connection of the direct oil return may be located at a lower end of the outgassing chamber.

The desired operating position may be defined, for example, by the center axis of the stationary spiral being at least substantially perpendicular to the direction of the gravitational force.

In a preferred embodiment, the scroll compressor comprises an outlet pressure chamber, wherein the oil separator is in direct fluid communication with the outlet of the compression section via the outlet pressure chamber. The outlet pressure chamber is in direct fluid communication with the compression section. The oil separator is in direct fluid communication with the outlet pressure chamber and consequently in direct fluid communication with the outlet of the compression section via the outlet pressure chamber. The outlet pressure chamber serves as a damping chamber for the discharged fluid. It flattens the outlet pressure.

In a particularly preferred further development, the outgassing chamber is formed radially outside the outlet pressure chamber and surrounds the outlet pressure chamber. The outgassing chamber has an essentially hollow-cylindrical shape, with the outlet pressure chamber arranged coaxially in the center of the outlet pressure chamber. This allows for a very compact design.

Preferably, the scroll compressor comprises a contact pressure chamber to which a contact pressure is applied during compression operation, the orbiting disk being pressed against the stationary disk by the contact pressure during operation.

The contact pressure chamber is located outside the direct oil return. The contact pressure chamber is not part of the direct oil return. The oil returned by the direct oil return does not pass through an internal space of the contact pressure chamber, which is subjected to contact pressure during operation. In a functional sense, the direct oil return "bypasses" the interior of the contact pressure chamber.

The direct oil return is physically separate from the contact pressure chamber. It is separate from the contact pressure chamber.

In particular, the outgassing chamber may be formed in addition to the contact pressure chamber, i.e. separately. For example, the contact pressure chamber can be arranged parallel to the center axis on a side of the orbiting disk facing away from the orbiting disk. The outgassing chamber, on the other hand, can be arranged parallel to the center axis on a side of the stationary disk facing away from the orbiting disk.

Particularly preferably, the scroll compressor comprises a second oil return for returning oil from the oil separator to the contact pressure chamber.

The second oil return is used to supply oil to the contact pressure chamber. The second oil return can be used to pressurize the contact pressure chamber. A rear side of the orbiting disk facing away from the stationary disk may form part of a boundary of the contact pressure chamber. Preferably, the second oil return leads from the oil separator directly to the contact pressure chamber. This ensures low complexity and that the scroll compressor is simple and inexpensive to produce.

In a highly advantageous embodiment of the invention, the second oil return comprises a flow valve. The flow valve influences the action of the second oil return. In particular, it influences the amount of oil that flows through the second oil return into the contact pressure chamber. Thus, the flow valve helps to tune and set the correct contact pressure in the contact pressure chamber.

Particularly preferably, the flow valve of the second oil return is designed as a throttle valve. This makes it much easier to tune the contact pressure through the second oil return (and possibly the reference return connection, see below). This increases the efficiency of the scroll compressor compared with designs without a throttle valve in the second oil return.

The second oil return is at least partially formed separately from the direct oil return (first oil return). The second oil return and the direct oil return may have a common initial section. In this case, the direct oil return branches off from the second oil return, the branch being located upstream of the contact pressure chamber as viewed along the second oil return (as viewed in the direction of flow of the oil). Particularly preferably, the branch along the second oil return is located upstream (in the direction of flow of the oil) of the flow valve of the second oil return. The common initial section begins with a common oil inlet opening into the oil separator.

In a highly preferred embodiment of the invention, the direct oil return has a first oil inlet opening into the oil separator and the second oil return has a second oil inlet opening into the oil separator. The second oil inlet is different from the first oil inlet. The second oil inlet is formed separately from the first oil inlet. In particular, the second oil inlet may be spatially distanced from the first oil inlet.

In a further development, the second oil return has priority over the direct oil return in the event of an oil shortage. When an amount of liquid oil in the oil separator falls below a predetermined value, an oil flow through the direct oil return is reduced relative to an oil flow through the second oil return, and/or the oil flow through the direct oil return is completely stopped.

In this condition, less or no oil is introduced into the compression section through the direct oil return. Consequently, the friction in the compression section increases and the efficiency decreases. However, the contact pressure chamber further gets supplied with oil. Temporary deficient lubrication can be compensated for temporarily by the oil in the outgassing chamber. In this way, the orbiting disk continues to be lubricated, at least from its rear side. In addition, if necessary, parts of the orbiting mechanism located in the contact pressure chamber are further lubricated. In addition, the contact pressure in the contact pressure chamber can be maintained more easily. Thus, the scroll compressor remains at least operable. Some lubrication of the compression section can be maintained, for example, by oil creeping from the contact pressure chamber past the orbiting disc into the compression section, by oil flowing from the contact pressure chamber into the compression section through a reference connection described further below, and/or by oil carried by the sucked fluid.

In an exceptionally preferred embodiment, the first oil inlet is arranged above the second oil inlet. "Above" in this context means that the first oil inlet opens into the oil separator upstream of (i.e., over) the second oil inlet, as viewed along the direction of the gravitational force, when the scroll compressor is positioned relative to the direction of the gravitational force in the desired operating position. In other words, the first oil inlet in the oil separator opens above the second oil inlet. In particular, the second oil inlet may be positioned at a lower end of an oil reservoir in the oil separator. In such an arrangement, when an oil level within the oil separator drops from a normal level, only the first oil inlet initially falls dry.

Alternatively or additionally, the scroll compressor may include a valve mechanism by which a flow of oil through the direct oil return is automatically reduced or stopped when the amount of liquid oil in the oil separator falls below the predetermined level. The valve mechanism may include one or more valves. For example, if the second oil return and the direct oil return have a common initial section, a branch valve may be formed at the branch of the direct oil return from the second oil return. The valve mechanism may include a level sensor that detects when the amount of liquid oil in the oil separator falls below the predetermined level.

Alternatively or additionally, the direct oil return is very preferably completely separate from the second oil return. This means that the direct oil return does not open directly into the second oil return at any point (and vice versa). In particular, the two do not have a common initial section in this case. In this sense, the second oil return and the direct oil return are not in direct fluid communication. This, of course, does not exclude that the first oil inlet of the direct oil return and the second oil inlet of the second oil return are directly (but indirectly) in fluid communication with each other via the interior of the heat exchanger.

Particularly preferably, the scroll compressor comprises a reference opening arranged in the compression section and a reference connection forming a fluid connection between the contact pressure chamber and the reference opening. The reference connection may be configured to influence the contact pressure based on a reference pressure applied to the reference opening during operation.

The reference opening can be formed in the orbiting base in the compressor channel of the orbiting disk or in the stationary base in the compressor channel of the stationary disk.

Most preferably, the reference opening is formed in the orbiting base in the compressor channel of the orbiting disk and the reference connection extends through the orbiting disk. This allows the reference connection to be implemented very easily and inexpensively.

The contact pressure is directly influenced by the reference pressure. For a given position of the reference opening in the compressor channel, the reference pressure in turn depends strongly on the intake pressure and possibly also on the outlet pressure. In this respect, a difference between the contact pressure and the intake pressure automatically adapts to an operating condition of the scroll compressor. A complex, external, susceptible and expensive control of the contact pressure is not required for this. In particular, no actively variable pressure control valve is required for setting and controlling the contact pressure. The interaction of the reference return connection and the reference opening establishes a pressure equilibrium in the contact pressure chamber. The specific design and set-up of the reference return connection and the reference opening, in particular the precise positioning of the reference opening in the corresponding compressor channel, enables the automatic setting of different, respectively desired contact pressures for different operating states of the scroll compressor. Accordingly, the contact force with which the orbiting disk is pressed onto the stationary disk by the contact pressure is adjusted for different operating states to the lift-off force acting on the orbiting disk in the respective operating state. This improves the efficiency and reliability of the scroll compressor.

The reference connection may comprise a flow valve. In particular, the flow valve can be designed as an uncontrolled throttle valve. This allows the contact pressure to be additionally influenced. The flow valve can also help to ensure that the pressure differences during a revolution of the orbiting disk do not act undamped in the contact pressure chamber.

Preferably, oil from the contact pressure chamber is fed between the stationary disk and the orbiting disk through a reference connection. In this case, in addition to the direct oil return, the scroll compressor also has an "indirect oil return", which returns oil from the oil separator indirectly and only indirect via the interior of the contact pressure chamber into the compression section. The indirect oil return includes the second oil return and the reference connection. Such an indirect oil return is, of course, not a direct oil return within the meaning of the present disclosure.

In a highly preferred embodiment of the invention, the scroll compressor has two compression chambers, the reference opening being arranged in the compressor channel (of the stationary disk or the orbiting disk) in such a way that, during a revolution of the orbiting disk, the reference opening is in direct fluid communication with a last-stage compression chamber for a first part of the time required for the revolution and with a penultimate-stage compression chamber for a further part of the time required for the revolution. The first part and the further part do not have to add up to the total time required for the revolution. Rather, there may be other parts.

This specific positioning of the reference opening ensures that even a high-pressure range of the scroll compressor has an influence on the contact pressure and that the contact pressure in compression operation is always set high enough in any operating state so that the contact force on the orbiting disk is sufficiently greater than the lift-off force. As a result, the orbiting disk is pressed tightly onto the stationary disk in any operating state during compression operation.

The last-stage compression chamber is characterized by the fact that the fluid in it is still guided at least partially into the outlet opening within this revolution of the orbiting disk during compression operation. The penultimate-stage compression chamber is characterized by the fact that the fluid in it will be at least partially guided into the outlet opening in compression operation within the next revolution of the orbiting disk.

For further explanations, details and embodiments regarding the reference return connection and the reference opening, specifically for a reference opening in the compressor channel of the stationary disk, reference is made to the disclosure documents DE 10 2017 125 968 A1 and WO 2019/092024 A1. The disclosures contained therein apply—insofar as adequate—accordingly to a reference opening in the compressor channel of the orbiting disk.

The scroll compressor may include an intake pressure chamber in fluid communication with the inlet of the compression section. In particular, the intake pressure chamber may be in direct fluid communication with the inlet of the compression section. In operation, the intake pressure chamber is subjected to the intake pressure.

The scroll compressor may have an intake connection. The intake connection may be in fluid communication with the inlet of the compression section via the intake pressure chamber.

The scroll compressor may have an outlet connection. The outlet connection may be in fluid communication with the oil separator. Preferably, an oil separator outlet opening for the fluid in the oil separator, which is in direct fluid communication with the outlet connection, may be arranged above the first oil inlet of the direct oil return (and optionally the second oil inlet of the second oil return). "Above" in this context means that the oil separator outlet opening in the oil separator is arranged in front of (i.e. over) the first oil inlet, as seen along the direction of the gravitational force, when the scroll compressor is positioned relative to the direction of the gravitational force in the desired operating position.

In a further embodiment of the invention, the outlet of the compression section comprises a non-return device. For example, it may comprise a non-return flap and/or a non-return valve. The non-return device prevents compressed fluid from flowing back (against the desired direction of flow) through the outlet of the compression section. Otherwise, fluid from the outlet pressure chamber could flow back through the outlet of the compression section if the outlet pressure in the outlet pressure chamber is higher than a pressure at the center of the stationary spiral.

The non-return device may (functionally and/or spatially) form a (downstream) end of the compression section.

Since the non-return device is part of the outlet of the compression section, the oil separator is in fluid communication with the outlet of the compression section even when the non-return device is closed. Accordingly, if the outlet pressure chamber is formed between the outlet of the compression section and the oil separator, the outlet pressure chamber is in direct fluid communication with the outlet of the compression section within the meaning of this application even when the non-return means is closed.

Particularly preferably, the outlet pressure chamber, the contact pressure chamber, the orbiting disk, the stationary disk, the return connection and the reference return connection are arranged in the intake pressure chamber. As a result, all of these components are securely enclosed by the intake pressure chamber. In this case, the intake connection and the outlet connection may be arranged on the intake pressure chamber, with the outlet connection in fluid communication with the oil separator in a pressure-tight manner.

In a further embodiment of the invention, the stationary spiral has at least 1.25 turns. This corresponds to a stationary spiral angle of at least 450°. This ensures sufficient maximum compression of the scroll compressor for usual applications.

Alternatively and/or additionally, the stationary spiral preferably has a maximum of 2.5 turns. This corresponds to a maximum stationary spiral angle of 900°. In this way, the scroll compressor remains compact, light and inexpensive to produce.

Particularly preferably, the stationary spiral has two turns, with the reference opening (to the contact pressure chamber) in the compressor channel being arranged at a position angle from the inner end of the stationary spiral which is at least 315° and at most 435°, very preferably at least 345° and at most 405°. This arrangement has proved to be particularly practicable.

If the second return connection has a plurality of orifice openings and/or a plurality of second return connections each having at least one orifice opening are provided, the individual orifice openings can each be designed independently of one another in accordance with any one of the aforementioned embodiments and modifications. The advantages apply accordingly. Thus, it is possible, for example, that all orifice openings are designed in the same way, that a first subset of all orifice openings is designed according to a first embodiment and a second subset of all orifice openings is designed according to a second embodiment, or, that all orifice openings are designed differently.

Preferably, the scroll compressor has an electric motor for driving the orbiting disc. The integration of the electric motor into the scroll compressor enables a particularly precise and efficient operation of the scroll compressor. The operation of the electric motor can be precisely matched to the specific scroll compressor. In particular, the drive of the scroll compressor is then not dependent on an operating state of other, external units. Very preferably, the electric motor is arranged inside the intake chamber. In a particularly preferred further development, the scroll compressor is an electric scroll compressor with integrated inverter.

Alternatively and/or additionally, the scroll compressor can also have a power transmission device for driving the orbiting disk by means of an external drive unit. The external drive unit may be an internal combustion engine, for example. The power transmission device may comprise a clutch (such as a magnetic clutch).

Optionally, the scroll compressor can also be used in a heat pump system, for example. This is of particular interest for air conditioning of electric vehicles and/or full hybrid vehicles.

The invention further relates to an air-conditioning system comprising a scroll compressor according to the invention. In particular, it can be an air conditioning system for a motor vehicle.

The described embodiments and advantages for the scroll compressor apply accordingly to the system.

The invention is explained below by means of embodiment examples and with reference to the figures. In this connection, all the features described and/or illustrated constitute the subject-matter of the invention, either individually or in any combination, even irrespective of their summary in the claims or references back thereto.

SCHEMATICALLY IT IS SHOWN

Figure 2:
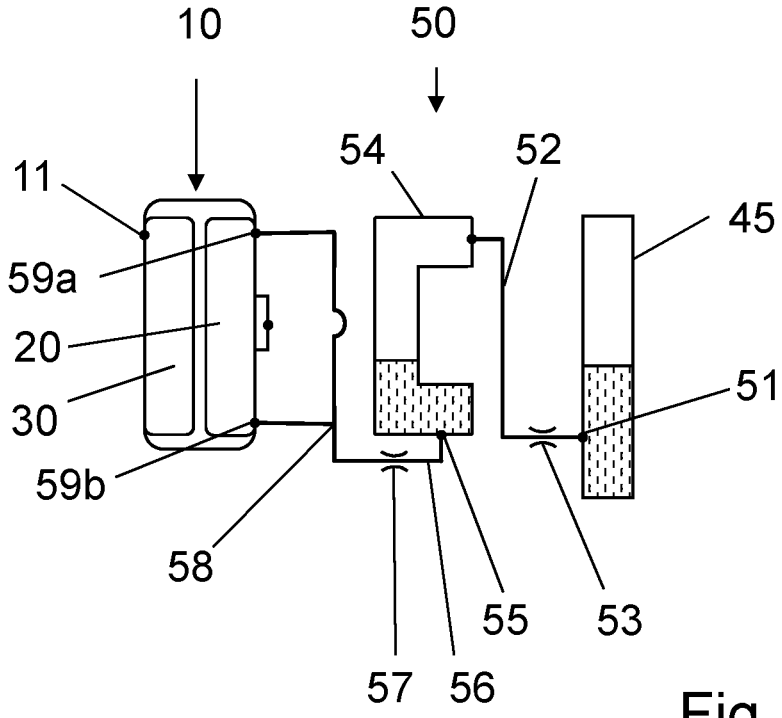
Figure 3:
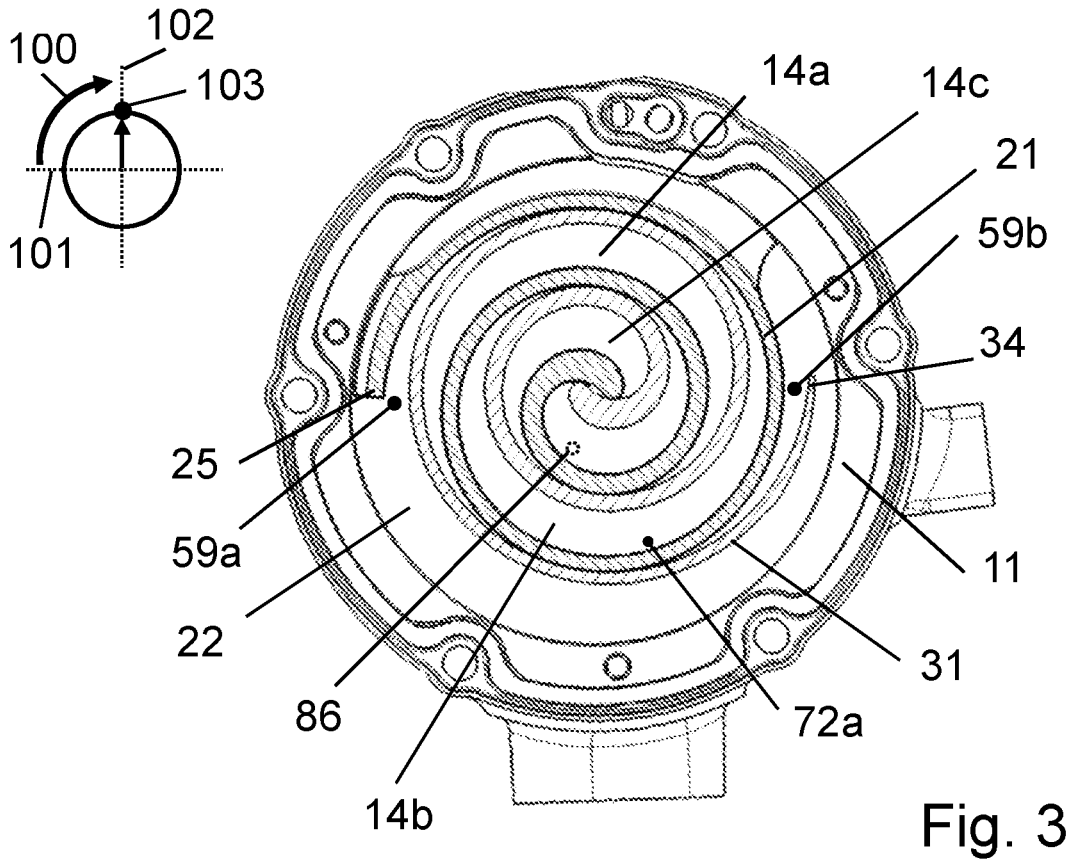
Figure 4:
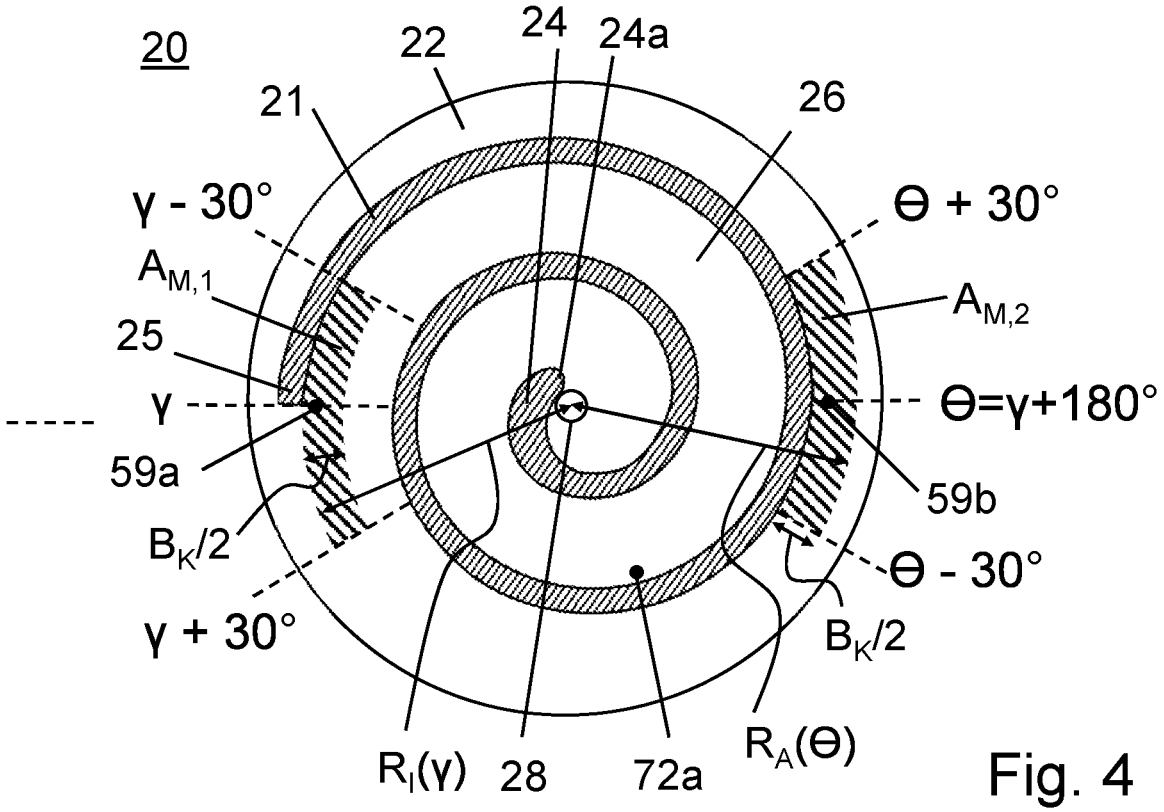
Figure 5:
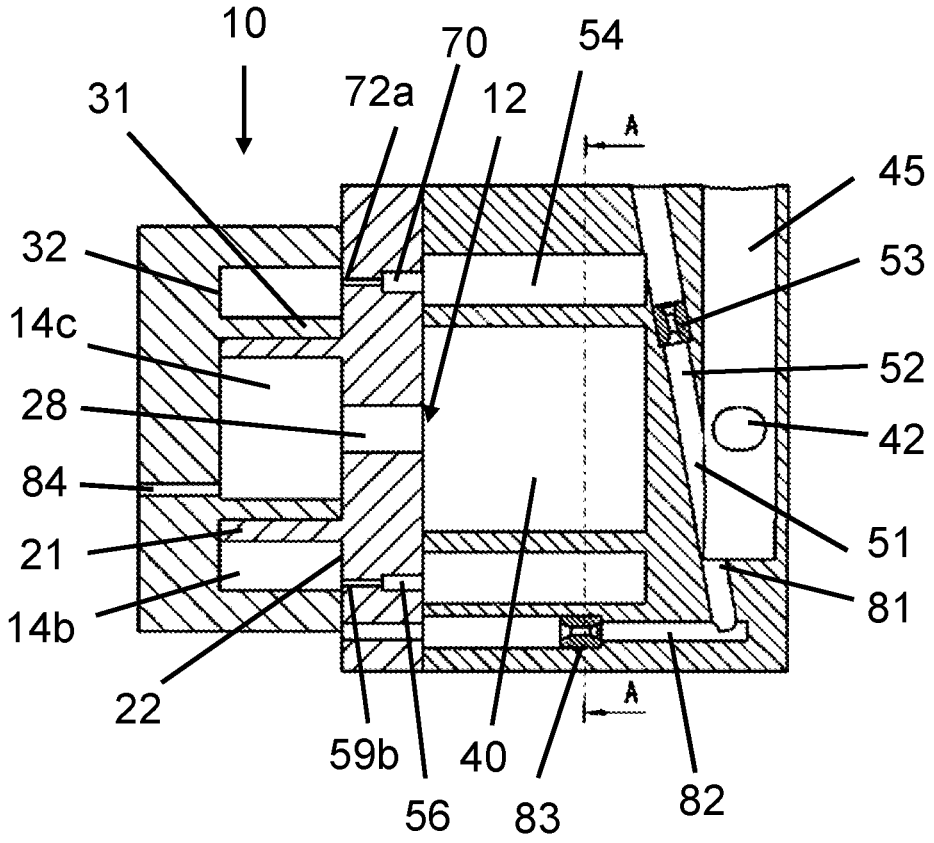
Figure 6:
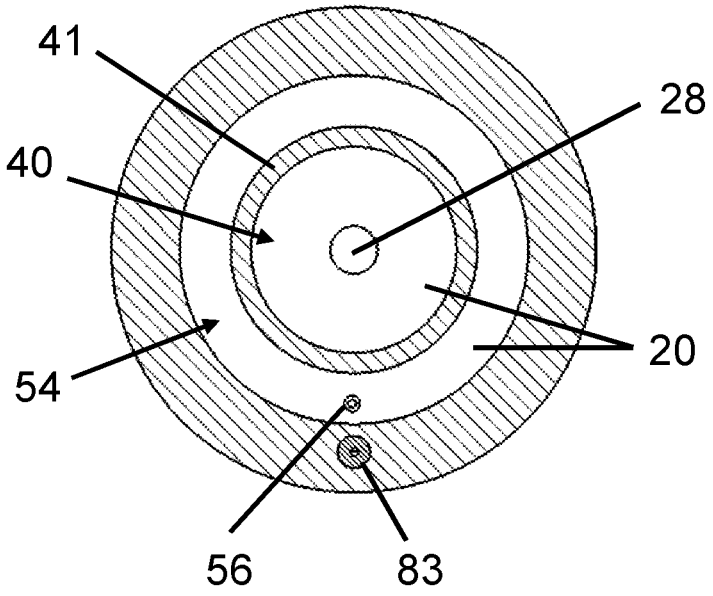

FIG. 1 a longitudinal section of a first embodiment of a scroll compressor according to the invention;

FIG. 2 a compression section, an oil separator and a direct oil return for direct return of oil from the oil separator to the compression section of the scroll compressor of FIG. 1;

FIG. 3 a cross-section of the compression section of FIG. 1 with two orifice openings of the direct oil return and one orifice opening of a fluid return for returning refrigerant from an outgassing chamber of the direct oil return, wherein all these orifice openings are arranged in a stationary disk of a stationary spiral of the compression section and wherein only an orbiting spiral is visible from an orbiting disk of the compression section;

FIG. 4 a top view of a modification of the stationary disk of the scroll compressor of FIG. 3 for a detailed explanation of a preferred arrangement of the orifice openings of the direct oil return;

FIG. 5 a longitudinal section of a compression section, an outlet pressure chamber, an oil separator and a direct oil return system for direct return of oil from the oil separator to the compression section according to a second embodiment of a scroll compressor according to the invention;

FIG. 6 a cross-section at section line A in FIG. 5; and

Figure 7:
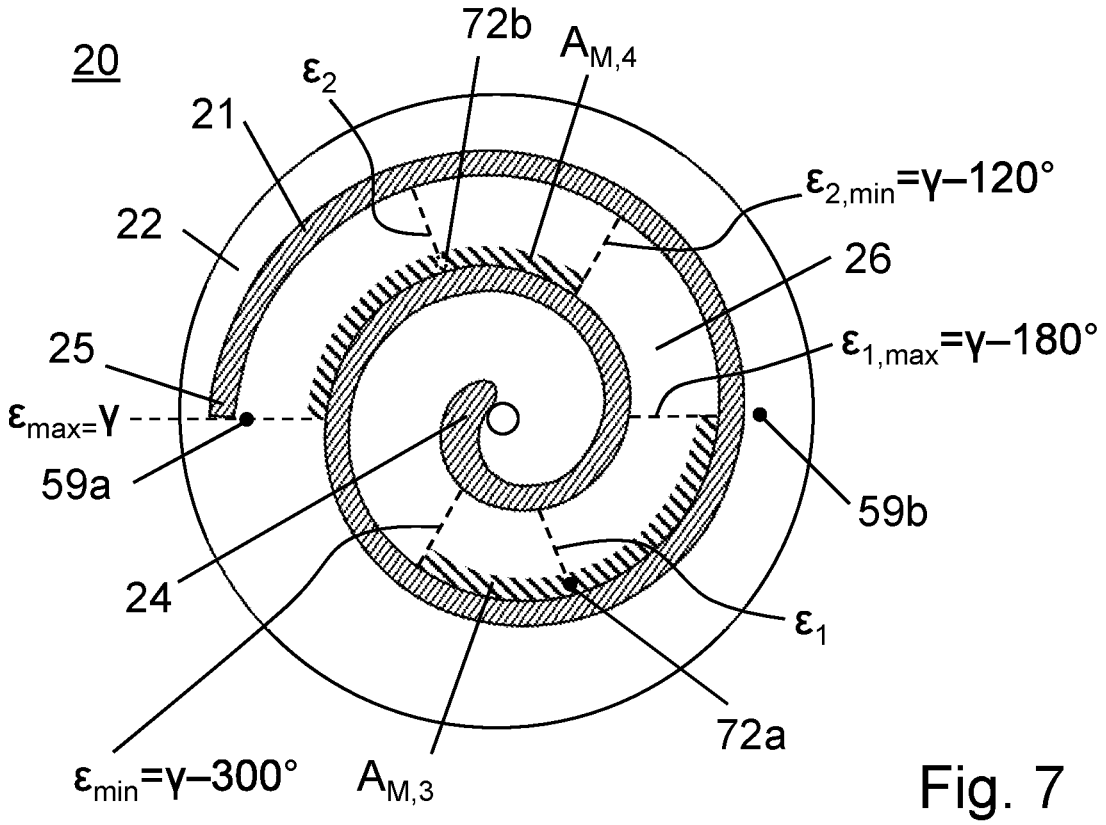

FIG. 7 a top view of the stationary disk in FIG. 3 FIG. 7 to explain advantageous positions for orifice openings of the fluid return system.

In FIG. 1, a first embodiment of a scroll compressor 1 according to the invention for compressing a fluid is shown schematically in a longitudinal section. The fluid is, for example, a refrigerant or a refrigerant mixture of a refrigerant circuit.

The scroll compressor 1 comprises a compression section 10 with an inlet 11, a stationary disk 20, an orbiting disk 30 and an outlet 12. An outlet pressure chamber 40 is directly connected to the outlet 12. In this embodiment, the outlet 12 includes a non-return device 13 that prevents compressed refrigerant from flowing back from the outlet pressure chamber 40 into the compression section 10. The non-return device 13 is exemplified here as a check valve and forms a downstream end of the compression section 10.

Seen along a flow direction of the refrigerant (in operation), an oil separator 45 directly adjoins the outlet pressure chamber 40. The oil separator 45 is thus in direct fluid communication with the outlet pressure chamber 40 and—via the outlet pressure chamber 40—in direct fluid communication with the outlet 12 of the compression section 10.

The scroll compressor 1 comprises a housing 90 having an intake connection 91 and an outlet connection 92.

The intake connection 91 is in direct fluid communication with the inlet 11 of the compression section 10 via an intake pressure chamber 93. In operation, refrigerant is drawn in from an external refrigerant circuit via the intake connection 91.

The outlet connection 92 is in direct fluid communication with an oil separator outlet opening 46 of the oil separator 45. Compressed refrigerant is discharged into the external refrigerant circuit via the outlet connection 92 during operation.

An intake pressure is present in the intake pressure chamber 93 and the inlet 11 of the compression section during operation. The intake pressure can be in the range of 0.7 bar to 9 bar, for example. In operation, there is an outlet pressure in the outlet pressure chamber 40, the oil separator 45 and the outlet connection 92 which is greater than the intake pressure. For example, the outlet pressure may be in the range of 6 bar to 32 bar. The intake pressure and the outlet pressure depend, among other things, on the refrigerant used and on an operating condition of the external refrigerant circuit.

The intake pressure chamber 93 is shown only schematically in FIG. 1. Preferably, the intake pressure chamber 93 encloses at least the contact pressure chamber 80 in a circumventing manner. That is, the intake pressure chamber 93 extends completely around the contact pressure chamber 80 along a circumferential direction (relative to the center axis). Alternatively or additionally, the intake pressure chamber 93 can enclose at least part of the compression section 10 in a circumventing manner. That is, the intake pressure chamber 93 extends along the circumferential direction (with respect to the central axis) completely around said part of the compression section 10. Said part of the compression section 10 may, in particular, face the contact pressure chamber 80 when viewed along the central axis.

For example, the intake pressure chamber 93 may be formed at least substantially in the shape of a cylinder barrel around the contact pressure chamber 80 and/or at least a part of the compression section 10 on the side of the contact pressure chamber 80.

The stationary disk 20 faces the outlet pressure chamber 40, while the orbiting disk 30 faces a contact pressure chamber 80.

A cut surface for FIG. 3 lies between the orbiting disk 30 and the stationary disk 20 in FIG. 1 and FIG. 2, respectively, and extends parallel to a stationary base 22 of the stationary disk 20. A stationary spiral 21 having 2.25 turns is arranged on the stationary base 22. Accordingly, an outer end 25 of the stationary spiral 21 is arranged at a spiral angle of 810° from an inner end 24 of the stationary spiral 21.

FIG. 4 is a simplified view of a top view of the stationary disk 20.

For simplicity, the orbiting spiral 31 in FIG. 4 is shown in a modification with two turns. Accordingly, the outer end 25 of the stationary spiral 21 is disposed at a spiral angle of 720° from the inner end 24 of the stationary spiral 21. Otherwise, the structure and function of the stationary disk 20 in FIG. 3 and FIG. 4 are the same, and the same reference signs are used for the same elements.

Returning to FIG. 3, only an orbiting spiral 31 is visible from the orbiting disk 30 due to the cross-section, which is arranged on an orbiting base 32 (not shown in FIG. 3; see FIG. 5) of the orbiting disk 30. The orbiting spiral 31 has (like the stationary spiral 21 design in FIG. 3) 2.25 turns.

The stationary disk 20 and the orbiting disk 30 are arranged nested within each other. In (compression) operation, the orbiting disk 30 is pressed onto the stationary disk 20 by a contact pressure in the contact pressure chamber 80 (see FIG. 1). As a result, on the one hand, an end face of the orbiting spiral 31 facing away from the orbiting base 32 is in sealing contact with the stationary base 22 and, on the other hand, an end face of the stationary spiral 21 facing away from the stationary base 22 is in sealing contact with the orbiting base 32.

The stationary base 22, the stationary spiral 21, the orbiting base 32 and the orbiting spiral 31 thus delimit a plurality of compression chambers 14*a*, 14*b*, 14*c*.

In the position of the orbiting disk 30 or the orbiting spiral 31 shown in FIG. 3, a compression chamber 14*c* of the last stage and two compression chambers 14*a*, 14*b* of the penultimate stage are defined in a compressor channel 26 formed between the turns of the stationary spiral 21, the compression chamber 14*c* of the last stage comprising two sub-sections which are in fluid communication with each other via narrow gaps (not visible in FIG. 3) between the stationary spiral 21 and the orbiting spiral 31.

On the left side of FIG. 3 is shown a pointer diagram depicting a revolution position 103 of the orbiting disk 30

(and thus the orbiting spiral 31) and its orbiting direction or a compression direction 100. The orbiting disk 30 starts a new revolution when its revolution position 103 in the pointer diagram is just at a revolution angle 101 of 0°. Then, an outer side of the orbiting spiral 31 just touches the outer end 25 of the stationary spiral 21, thereby closing the outer-side-guided compression chamber of penultimate stage 14*b*. At the same time, an outer end 34 of the orbiting spiral 31 contacts an outer side of an outermost turn of the stationary spiral 21, thereby closing the inner-side-guided compression chamber of penultimate stage 14*a*. In FIG. 3, starting from the revolution angle 101 of 0°, the orbiting disk 30 has already moved along the compression direction 100 to the revolution position 103 at a revolution angle 102 of 90°. Starting from FIG. 3, the orbiting disk 30 orbits further along the compression direction 100 around a center of the stationary spiral 21.

Starting from FIG. 3, when the orbiting disk 30 orbits another 270° along the compression direction 100 relative to the stationary disk 20, it reaches a revolution position at the revolution angle 101 of 0° and its current revolution ends. The refrigerant, which in FIG. 3 had been in the compression chamber of last stage 14*c*, has been led to a large extent into an outlet opening 28 in the stationary base 22 and thus to the outlet 12 of the compression section 10. The outlet opening 28 is located at a center of the stationary disk 20 or stationary spiral 21.

The scroll compressor 1 has a direct oil return 50 for returning oil from oil separator 45 to the compression section 10.

More specifically, the direct oil return 50 extends from a first oil inlet 51 in the oil separator 45 to two orifice openings 59*a*, 59*b* in the stationary base 22 of the stationary disk 20. In operation, the direct oil return 50 injects oil from the oil separator 45 from the orifice openings 59*a*, 59*b* directly between the stationary disk 20 and the orbiting disk 30.

In the embodiment shown in FIG. 1, the direct oil return 50, viewed along the direction of flow of the oil, comprises the first oil inlet 51, a first fluid connection 52 with a first throttle valve 53, an outgassing chamber 54, a second fluid connection 56 with a second throttle valve 57 and a branching 58, and further two orifice openings 59*a*, 59*b*.

In operation, the outlet pressure prevails in the interior of the oil separator 45. In the oil separator 45, the refrigerant rises while liquid oil accumulates in a lower half of the oil separator 45. Thus, the refrigerant and the oil are separated from each other. There is increased solubility for the refrigerant in the liquid oil due to the high outlet pressure, and the liquid oil contains a portion of dissolved refrigerant.

The first oil inlet 51 is disposed in a lower half of an interior of the oil separator 45, while the oil separator outlet opening is disposed at an upper end of the interior of the oil separator 45. The outlet pressure forces liquid oil from the oil separator 45 through the first oil inlet 51 into the first fluid connection 52.

In the first fluid connection 52 of the direct oil return 50, this oil flows through the first throttle valve 53. The first throttle valve 53 may be configured as an unregulated throttle valve. For example, the first throttle valve 53 may be designed as an orifice or nozzle. The first throttle valve 53 reduces the mass flow of the oil. The oil then continues to flow into the outgassing chamber 54. By influencing the mass flow of the oil, an intermediate pressure in the outgassing chamber 54 can be influenced. Due to the pressure drop, the solubility for the refrigerant in the oil decreases. The oil may be oversaturated with refrigerant after the first throttle valve 53. An oversaturation fraction of the refrigerant may evaporate in the outgassing chamber 54. Liquid oil collects in a lower portion of the outgassing chamber 54 and refrigerant collects in an upper portion of the outgassing chamber 54. The outgassing chamber 54 acts, so to speak, as an additional oil separator of the direct oil return 50 and a fluid return 70.

In the lower region of the outgassing chamber 54, for example at a bottom region of the outgassing chamber 54, an oil inlet 55 of the second fluid connection 56 of the direct oil return 50 is arranged. Due to the intermediate pressure prevailing in the exhaust chamber 54, liquid oil is forced from the exhaust chamber 54 through the oil inlet 55 into the second fluid connection 56.

The second fluid connection 56 has a second throttle valve 57, which limits a mass flow rate of the oil exiting the outgassing chamber. Incidentally, this can also prevent an undesirably large drop in the intermediate pressure in the outgassing chamber 54. The second throttle valve 57 may also be designed as an unregulated throttle valve, for example as an orifice or nozzle.

Downstream of the second throttle valve 57, the second fluid connection 56 branches into two arms at a branching 58. Both arms pass at least partially through the stationary disk 20, each terminating in one of the orifice openings 59*a*, 59*b* disposed in the stationary base 22.

Each of the orifice openings 59*a*, 59*b* is thereby arranged in an inlet region of the compression section 10, which in operation is at least temporarily in direct fluid communication with the inlet 11 of the compression section 10. As a result, oil escaping from the orifice openings 59*a*, 59*b* is entrained by the sucked-in refrigerant and then enclosed together with the refrigerant in newly formed compression chambers. Because the orifice openings 59*a*, 59*b* are each positioned in the inlet area of the compression section 10, the radially outer engagement areas of the stationary spiral 21 and the orbiting spiral 31 are also excellently lubricated.

In addition, all orifice openings 59*a*, 59*b* are each swept at least once by the orbiting spiral 31 during each revolution of the orbiting disk 30. This ensures good distribution of the oil supplied. The oil coming out of the orifice openings 59*a*, 59*b* is smeared by the orbiting spiral 31. For example, it can be seen from FIG. 4 that the orifice opening 59*a* is swept by an outer end 34 of the orbiting spiral 31 in each revolution.

Particularly preferred positioning of the orifice openings 59*a*, 59*b* will be discussed in more detail below with reference to FIG. 4.

In the compression chambers 14*a*, 14*b* 14*c* (see FIG. 3) formed in the compression section 10 between the stationary disk 20 and the orbiting disk 30, the refrigerant is transported to the center of the stationary spiral 21 and thereby compressed by reducing the volumes of the compression chambers 14*a*, 14*b*, 14*c* until it reaches outlet pressure. It is then moved through the outlet 12, which in this example includes an outlet opening 28 at the center of stationary disk 20 and the non-return device 13, and outlet pressure chamber 40 into oil separator 45.

Oil is transported together with the refrigerant and finally returns to the oil separator 45, where it is separated from the refrigerant and is available for a new cycle of direct oil return 50. The refrigerant, freed from the oil, compressed and under outlet pressure, is discharged from the scroll compressor 1 through the oil separator outlet opening 46 and outlet connection 92.

With reference to FIG. 4, it will now be explained where the orifice openings 59*a*, 59*b* of the direct oil return may preferably be arranged.

A position angle of 0° is determined by the inner end 24 of the stationary spiral 21. It should be noted that a terminal bead 24*a* of the inner end 24 is irrelevant to the determination of the position angle of 0°. Since the stationary spiral 21 in FIG. 4 has two turns, its outer end 25 is arranged at a position angle or spiral angle of 720°. Correspondingly, an inlet opening of a compressor channel 26, extending between the outer end 25 and a beginning of an outer turn of the stationary spiral 21 at a position angle of 360°, is located at the position angle 720°.

FIG. 4 shows a preferred first area $A_{M,1}$ for the arrangement of orifice openings of the direct oil return 50.

In FIG. 4, γ is a position angle of the outer end 25 of the stationary spiral 21. Accordingly, γ is also a position angle of an outer end of the compressor channel 26. At the position angle γ, the inner side of the stationary spiral 21 has a distance $R_I(\gamma)$ from the center of the stationary spiral 21 in a radial direction. At the same time, an inlet opening of the compressor channel 26 of the stationary disk 20 has a width $B_K$ at the position angle in the radial direction. Here, the width $B_K$ is obtained as $B_K=R_I(\gamma)-R_A(\gamma-360°)$, where $R_A(\gamma-360°)$ is a distance of the outer side of the stationary spiral 21 at a position angle corresponding to γ−360°.

The first area $A_{M,1}$ extends in the circumferential direction from a position angle γ−30° to a position angle of γ+30° and in the radial direction from $R_I(\gamma)-B_K/2$ to $R_I(\gamma)$. This means that the first area $A_{M,1}$ is arranged at the inlet opening of the compressor channel 26, namely on a radially outer half of the compressor channel 26 in this position angle area or its imaginary continuation.

In FIG. 4, the orifice opening 59*a* is positioned in the first area $A_{M,1}$ exactly at the position angle γ=720° and close to the outer side of the compressor channel 26, for example with a radial distance $R_I(\gamma)-B_K/10$ from the center of the stationary spiral 21. The orifice opening 59*a* is closed only once per revolution by the orbiting spiral 31. In the embodiment shown, it does not directly communicate with inner-side-guided compression chambers 14*b*. The orifice opening 59*a* ensures lubrication of the outer-side-guided compression chambers in a particularly advantageous manner. In FIG. 3, the compression chamber 14*b* is outer-side-guided.

FIG. 4 further shows a preferred second area $A_{M,2}$ for the arrangement of orifice openings of the direct oil return 50. In this example, the orifice opening 59*b* is positioned in the second area $A_{M,2}$.

The second regions $A_{M,2}$ extends radially outwardly of the stationary spiral 21 about a position angle θ, where θ=γ+180°. The second area $A_{M,2}$ extends circumferentially from a position angle θ−30° to a position angle of θ+30° and radially from $R_A(\theta\ 360°)$ to $R_A(\theta\ 360°)+B_K/2$. A second area $A_{M,2}$ therefore lies outside the compressor channel 26 of the stationary disk 20, more specifically on a side opposite to the inlet opening of the compressor channel 26. Here, $R_A(\theta\ 360°)$ is a radial distance of the outer side of the stationary spiral 21 at the position angle θ 360°=γ−180°.

In FIG. 4, the orifice opening 59*b* is positioned in the second area $A_{M,2}$ exactly at the position angle θ=900° and close to the outer side of the outermost turn of the stationary spiral 21, for example, at a radial distance $R_A(\theta)+B_K/10$ from the center of the stationary spiral 21. The orifice opening 59*b* provides lubrication of inner-side-guided compression chambers in a particularly advantageous manner. In FIG. 3, the compression chamber 14*b* is inner-side-guided.

In FIG. 3, the orifice openings 59*a*, 59*b* of the direct oil return 50 are also positioned as described with reference to FIG. 4.

The scroll compressor 1 further comprises a fluid return 70 for returning refrigerant from the outgassing chamber 54 to the compression unit. A fluid inlet 71 of the fluid return 70 is arranged in an upper portion of the outgassing chamber 54. Thus, no liquid oil flows from the outgassing chamber 54 into the fluid return 70.

The fluid return 70 extends through the stationary disk 20. An orifice opening 72*a* of the fluid return 70 is arranged in the compressor channel 26 of the stationary disk 20 (see FIG. 3 and FIG. 5). Here, the orifice opening 72*a* is located in an inlet region of the compressor channel 26, but is also swept by closed compression chambers at times. In FIG. 3, the compression chamber 14*b* of penultimate stage is presently sweeping over the orifice opening 72*a*. Consequently, a time average of the pressure of the refrigerant in the compressor channel 26 at the orifice opening 72*a* is higher than the intake pressure. In the present embodiment, the intermediate pressure in the outgassing chamber 54 in proper operation is higher than the time-average pressure of the refrigerant in the compressor channel 26 at the position of the orifice opening 72*a*, in the range of 0.2 bar to 1.5 bar, depending on the exact operating condition. The pressure difference with respect to the outlet pressure forces liquid oil out of the outgassing chamber into the second fluid connection 56 and out of the orifice openings 59*a*, 59*b* of the direct oil return 50.

The intermediate pressure in the outgassing chamber 54 is influenced in particular by:

- The outlet pressure and the mass flow of the oil together with the co-transported refrigerant, which flow through the first fluid connection 52 into the outgassing chamber 54,
- the time-average pressures at the orifice openings 59*a* and 59*b* and the corresponding mass flow of oil leaving the outgassing chamber 54 through the second fluid connection 56, and
- the time average of the pressure of the refrigerant in the compressor chamber 26 at the orifice opening 72*a* and the corresponding mass flow of the refrigerant leaving the outgassing chamber 54 through the fluid return 70.

The driving force is the outlet pressure in the oil separator 45.

In this embodiment, the intermediate pressure (or a time-average value of the intermediate pressure under unchanged operating conditions) is in the range of 0.3 bar to 5 bar above the intake pressure during operation. At an intake pressure of 1 bar, the intermediate pressure in operation is a minimum of 0.3 bar above the intake pressure, i.e. 1.3 bar in absolute terms, and a maximum of 1.9 bar, i.e. 2.9 bar in absolute terms. At an intake pressure of 7 bar, the intermediate pressure in operation is a maximum of 4.2 bar above the intake pressure, i.e. 11.2 bar. Of course, even then the intermediate pressure remains well below the outlet pressure, which in this case is 32 bar. At an intake pressure of 5 bar, the intermediate pressure is in the range of 0.6 bar to 3.5 bar above the intake pressure. These values are examples. The exact intermediate pressure depends on the exact operating condition, for example also on the outlet pressure. The exact pressure ratios may also depend on the refrigerant used.

In other words, the intermediate pressure in operation ranges from 1.3 bar (minimum intermediate pressure) to 11.2 bar (maximum intermediate pressure).

With reference to FIG. 7, advantageous positions for orifice openings 72*a*, 72*b* of the fluid return 70 are explained below.

In general, the orifice opening 72*a*, 72*b* of the fluid return 70 in the compressor channel 26 is preferably arranged at a position angle (of the compressor channel 26) which is in a range of $\varepsilon_{min}=\gamma-300°$ and $\varepsilon_{max}=\gamma$, where $\gamma$ is the position angle of the outer end of the compressor channel.

FIG. 7 shows two particularly preferred areas $A_{M,3}$ and $A_{M,4}$ for the arrangement of orifice openings 72*a*, 72*b* of the fluid return 70 in the compressor channel 26.

The one area $A_{M,3}$ for the arrangement of orifice openings 72*a* is defined in that an orifice opening 72*a* of the fluid return 70 located therein is arranged at a position angle $\varepsilon_1$ which is in a range from $\varepsilon_{min}=\gamma-300°$ to $\varepsilon_{max}$, $1=\gamma-180°$, the orifice opening 72*a* being further arranged such that it is swept only by outer-side-guided compression chambers 14*b* and is swept exactly once per revolution by the orbiting spiral 31. For example, in FIG. 3, FIG. 4 and FIG. 7, the orifice opening 72*a* of the fluid return 70 is located in the compressor channel 26 at a position angle $\varepsilon_1=\gamma-248°$. Furthermore, the orifice opening 72*a* is arranged on the outer side of the compressor channel 26 at this position angle. As a result, the orifice opening 72*a* in this embodiment is swept only by outer-side-guided compression chambers 14*b*. The orifice opening 72*a* here at no time is in direct fluid communication with any of the inner-side-guided compression chambers 14*a*.

More precisely, the orifice opening 72*a* of the fluid return 70 in this embodiment is closed by the orbiting spiral 31 in the range of the revolution angle from 0° to 20°. When the revolution angle reaches 20°, the outer-side-guided compression chamber 14*b* begins to sweep over the orifice opening 72*a*. In a range of the revolution angle from 20° to 270°, the orifice opening 72*a* and the outer-side-guided compression chamber 14*b* are in fluid communication. For example, at the revolution angle of 90° shown in FIG. 3, the orifice opening 72*a* of the fluid return 70 is in direct fluid communication with the outer-side-guided compression chamber 14*b* over its full area. In a range of the revolution angle of 270° to 360°, the orbiting spiral 31 closes the orifice opening 72*a* again.

At the revolution angle of 20°, the pressure of the refrigerant in the outer-side-guided compression chamber 14*b*, which just enters into fluid communication with the orifice opening 72*a*, is already slightly above the intake pressure. This is due to the fact that this compression chamber 14*b* has already been closed shortly before at the revolution angle of 0° (reference sign 101) and has already been reduced somewhat up to the revolution angle of 20°.

For the following example, assume an intake pressure of 3 bar. Then the pressure of the refrigerant in this compression chamber 14*b* at the revolution angle of 20° is, for example, 3.08 bar. Up to the revolution angle of 270°, the pressure of the refrigerant in this compression chamber 14*b* increases continuously to 4.76 bar in this example. The time average value of the pressure of the refrigerant in the compressor channel 26 at the orifice opening 72*a* is thereby 3.76 bar, it is therefore 0.76 bar above the intake pressure of 3 bar. This is a non-limiting example for a certain operating condition.

For example, in the embodiment according to FIG. 3, the time-average value of the pressure of the refrigerant in the compressor channel 26 at the position of the orifice opening 72*a* of the fluid return 70 is

- at an intake pressure of 1 bar at 126% of this intake pressure,
- at an intake pressure of 3 bar at 125% of this intake pressure,
- at an intake pressure of 5 bar at 124% of this intake pressure and
- at an intake pressure of 7 bar at 123% of this intake pressure.

If the orifice opening 72*a* of the fluid return 70 is displaced in a modification of the embodiment not shown in the range $A_{M,3}$ to a position angle of $\varepsilon_1=\gamma-295°$, then the time average value of the pressure of the refrigerant in the compressor channel 26 at the position of the orifice opening 72*a* of the fluid return 70 is in the range of 138% to 142% of the respective intake pressure, for example, depending on the operating state.

If the orifice opening 72*a* of the fluid return 70 in a modification of the embodiment not shown is shifted in the range $A_{M,3}$ to a position angle of $\varepsilon_1=\gamma-190°$, then the time average value of the pressure of the refrigerant in the compressor channel 26 at the position of the orifice opening 72*a* of the fluid return 70 is in the range of 107% to 109% of the respective intake pressure, for example, depending on the operating state.

The other range $A_{M,4}$ for the arrangement of orifice openings 72*b*' is defined in that an orifice opening 72*b* of the fluid return 70 located therein is arranged at a position angle $\varepsilon_2$ which is in a range from $\varepsilon_{min,2}=\gamma-120°$ to $\varepsilon_{max}=\gamma$, wherein the orifice opening 72*b* is further arranged such that it is swept only by inner-side-guided compression chambers 14*a* and is swept exactly once per revolution by the orbiting spiral 31.

In FIG. 7, the position for an orifice opening 72*b* in the region $A_{M,4}$ with a position angle $\varepsilon_2=\gamma-68°$ is drawn as an example. Furthermore, the orifice opening 72*b* is arranged on the inner side of the compressor channel 26 at this position angle $\varepsilon_2$. As a result, this orifice opening 72*b* is swept only by inner-side-guided compression chambers 14*a*. The orifice opening 72*b* is therefore at no time in direct fluid communication with any of the outer-side-guided compression chambers 14*b*. This orifice opening 72*b* can be formed alternatively or in addition to the other orifice opening 72*a* of the fluid return 70 shown in FIG. 7.

When the compression chambers 14*a*, 14*b* are closed, the position angle of the inner-side-guided compression chambers 14*a* is offset by +180° with respect to the position angle of the outer-side-guided compression chambers 14*b*. Since the position angle of the orifice opening 72*b* is also offset by +180° relative to that of the orifice opening 72*a*, the pressure conditions at the orifice opening 72*b* develop similarly to those at the orifice opening 72*a* during a revolution.

In an embodiment not shown, an orifice opening of the fluid return 70 may be disposed, for example, at a position angle in the range of εmax,1 to εmin,2. Such an orifice opening may be arranged in a central portion of the compressor channel 26 at this position angle, so that it is completely closed by the orbiting spiral 31 twice in each revolution and alternately enters into fluid communication with inner-side-guided compression chambers 14*a* and with outer-side-guided compression chambers 14*b*. As a result, the average pressure of the refrigerant at this orifice opening is between the average pressure of the refrigerant in outer-side-guided compression chambers 14*b* on the outer side of compressor channel 26 at this position angle and the average pressure of the refrigerant in inner-side-guided compression chambers 14*a* on the inner side of compressor channel 26 this position angle. As mentioned elsewhere, the time periods during which the orifice opening is completely closed by the orbiting spiral 31 can be left out for calculating the average pressure of the refrigerant at the orifice opening.

The scroll compressor 1 also includes a second oil return 82. The second oil return 82 returns oil from the oil separator 45 to the contact pressure chamber 80. It comprises a second oil inlet 81 in the oil separator 45 and a throttle valve 83 arranged between the second oil inlet and the contact pressure chamber 80 in the second oil return 82.

In operation, the outlet pressure prevailing in the oil separator 45 forces oil through the second oil inlet 81 into the second oil return 82. The pressure of the oil is reduced by the throttle valve 83. The pressure drop in the throttle valve 83 affects the contact pressure.

The oil in the contact pressure chamber 80 contributes to the lubrication of the orbiting disk 30. In addition, a small amount of the oil can creep past the orbiting disk 30 and into the interior of the compression section 10.

The scroll compressor 1 shown in FIG. 1 also includes a reference connection 84 between an interior of the contact pressure chamber 80 to a reference opening 86. The reference opening 86 is disposed in the orbiting base 32 of the orbiting disk 30, specifically in a compressor channel of the orbiting disk 30. The reference connection 84 influences the contact pressure in the contact pressure chamber 80 depending on the operating condition of the scroll compressor 1. The reference connection 84 leads from the contact pressure chamber 80 through the orbiting disk 30 to the reference opening 86 in the orbiting base 32.

The reference opening 86 of the reference connection 84 is positioned further inward, as viewed in the radial direction, than the orifice openings 59*a*, 59*b* of the direct oil return 50. In FIG. 3, a position of the reference opening 86 of the reference connection 84 in an outlet region of the compressor channel of the orbiting disk 30 is indicated. Therefore, the reference connection 84 cannot contribute much, if at all, to the lubrication of the radially outer portions of the stationary spiral 21 and the orbiting spiral 31. The reference opening 86 is not located in the inlet region of the compressor channel of the orbiting disk 30. Therefore, in operation of the scroll compressor 1, there is no direct fluid connection between the inlet 11 of the compression section 10 and the reference opening 86.

Optionally, the reference connection 84 comprises a throttle valve 85. The throttle valve 85 contributes to the regulation of the contact pressure.

The second oil inlet 81 of the second oil return 82 is arranged in a bottom region of the oil separator 45. In particular, it is arranged below the first oil inlet 51 of the direct oil return 50. In operation, when an oil level in the oil separator 45 drops to a level below the first oil inlet 51, the first oil inlet 51 falls dry and is no longer supplied with oil. However, the second oil inlet 81 continues to be supplied with oil. The oil supply to the second oil return thus has priority over the oil supply to the direct oil return 50. This ensures that the contact pressure is maintained even in the event of an oil shortage. Some lubrication of the compression section 10 is maintained by oil creeping past the outside of the orbiting disk 30, as well as by oil returning to the inlet 11 of the compression section 10 from the external refrigerant circuit. In addition, oil from the contact pressure chamber 80 may enter the compression section 10 through the reference connection 84, especially when an oil level in the contact pressure chamber is very high.

The scroll compressor 1 further includes an electric motor and an inverter for the electric motor (not shown). The scroll compressor 1 is capable of being integrated into a refrigerant circuit of a vehicle. For example, the scroll compressor 1 may be incorporated into an electric vehicle or a hybrid vehicle.

FIG. 5 shows a longitudinal section of a compression section 10, an outlet pressure chamber 40, an oil separator 45 and a direct oil return 50 for direct return of oil from the oil separator 45 to the compression section 10 according to a second embodiment of a scroll compressor according to the invention. The remaining elements of this scroll compressor are not shown. The scroll compressor and its components correspond to the structure and operation of the scroll compressor 1 of FIG. 1, unless otherwise indicated. The same reference signs are used for the same elements.

FIG. 6 shows a cross-section at section line A in FIG. 5.

In FIG. 5 and FIG. 6, it is shown that the outgassing chamber 54 is formed outside the outlet pressure chamber 40 in the radial direction (perpendicular to the center axis of the stationary disk 20) and surrounds the outlet pressure chamber 40. The outgassing chamber 54 has a (at least substantially) hollow cylindrical shape. The outlet pressure chamber 40 has an (at least substantially) cylindrical shape. The outlet pressure chamber 40 and the outgassing chamber 54 are coaxially arranged. A hollow cylindrical jacketing wall 41 of the outlet pressure chamber 40 separates the outlet pressure chamber 40 and the outgassing chamber 54 from each other. In this way, the otherwise unused space around the jacketing wall 41 is used in an advantageous manner.

The outlet pressure chamber 40 is in direct fluid communication with the oil separator 45 via an opening 42. Similar to FIG. 1, a non-return device can optionally be formed at the outlet 12 of the compression section 10 (not shown).

The described embodiments with the direct oil return 50 allow a particularly efficient operation and exhibit a high reliability.

LIST OF REFERENCE SIGNS

1 scroll compressor
10 compression section
11 inlet (of the compression section)
12 outlet (of the compression section)
13 non-return device
14*a*, 14*b*, 14*c* compression chamber
20 stationary disk
21 stationary spiral
22 stationary base
24 inner end (of the stationary spiral)
25 outer end (of the stationary spiral)
26 compressor channel (of the stationary disk)
28 outlet opening (of the stationary disk)
30 orbiting disk
31 orbiting spiral
32 orbiting base
34 outer end (of the orbiting spiral)
40 outlet pressure chamber
41 jacketing wall
42 opening
45 oil separator
46 oil separator outlet opening
50 direct oil return
51 first oil inlet
52 first fluid connection
53 first flow valve (throttle valve)
54 outgassing chamber
55 oil inlet
56 second fluid connection
57 second flow valve (throttle valve)
58 branching
59*a*, 59*b* orifice opening (of the direct oil return)
70 fluid return

71 fluid inlet
72*a*, 72*b* orifice opening (of the fluid return)
80 contact pressure chamber
81 second oil inlet
83 flow valve (throttle valve)
84 reference connection
85 flow valve (throttle valve)
86 reference opening
90 housing
91 intake connection
92 outlet connection
93 intake pressure chamber
$A_{M,1}$, $A_{M,2}$, $A_{M,3}$, $A_{M,4}$ Range
$\varepsilon_1$, $\varepsilon_2$, $\varepsilon_{min}$, $\varepsilon_{max}$ position angle
$\varepsilon_{1,max}$, $\varepsilon_{2,min}$ position angle
$\gamma$ position angle of the outer compressor channel
$\theta$ position angle
$R_I(\gamma)$ radial distance of the inner side of the stationary spiral at the outer end of the compressor channel.
$B_K$ width of the compressor channel in the radial direction at the outer end of the compressor channel $R_A(\theta-360°)$ radial distance of the outer side of the stationary spiral at the position angle $\theta-360°$

The invention claimed is:

1. Scroll compressor for compressing a fluid, comprising:
a compression section with
an inlet of the compression section for sucking the fluid into the compression section,
an outlet of the compression section for discharging the compressed fluid out of the compression section,
a stationary disk having a stationary spiral, and
an orbiting disk having an orbiting spiral, the orbiting disk being orbitable relative to the stationary disk along a compression direction to move the fluid from the inlet of the compression section to the outlet of the compression section, thereby compressing the fluid; and
an oil separator for separating oil from the compressed fluid;
wherein the scroll compressor additionally comprises a direct oil return for directly returning oil from the oil separator to the compression section, the direct oil return comprising at least one orifice opening,
wherein the direct oil return comprises a first flow valve,
characterized in that the direct oil return comprises an outgassing chamber arranged between the first flow valve and the orifice opening of the direct oil return, and
in that the scroll compressor has a fluid return for returning fluid from the outgassing chamber to the compression section.

2. Scroll compressor according to claim 1, characterized in that the orifice opening of the direct oil return is arranged in the stationary disk.

3. Scroll compressor according to claim 2, wherein the stationary disk comprises the stationary spiral arranged on a stationary base of the stationary disk and forming a spiral compressor channel of the stationary disk,
characterized in that the orifice opening of the direct oil return is arranged in an intake portion of the compressor channel which, in operation, is at least temporarily in direct fluid communication with the inlet of the compression section or is arranged outside the compressor channel.

4. Scroll compressor according to claim 3, wherein the stationary disk comprises the stationary spiral, which is arranged on the stationary base of the stationary disk and forms the spiral-shaped compressor channel, characterized in that the orifice opening of the direct oil return
either is disposed at a position angle in a range of $\gamma-30°$ and $\gamma+30°$, where $\gamma$ is a position angle of an outer end of the compressor channel, and is disposed at a radial distance $R_{M,1}$ from a center of the stationary disk, where $R_{M,1}$ is in a range between $(R_I(\gamma)-B_K)$ and $R_I(\gamma)$, where $R_I(\gamma)$ is a radial distance of an inner side of the stationary spiral at an outer end of the compressor channel, and $B_K$ is a width of the compressor channel along the radial direction at the outer end of the compressor channel,
or outside the stationary spiral and at a position angle in the range of $\theta-30°$ to $\theta+30°$, and at a radial distance $R_{M,2}$ from the center of the stationary disk (20), where $\theta=\gamma+180°$, and $R_{M,2}$ is in a range of $R_A(\theta-360°)$ to $R_A(\theta-360°)+B_K$, where $R_A(\theta-360°)$ is a radial distance of an outer side of the stationary spiral at the position angle $\theta-360°$.

5. Scroll compressor according to claim 3, wherein during compression operation at least one compression chamber is formed between the orbiting spiral and the stationary spiral, characterized in that the at least one orifice opening is not swept by any compression chamber at any time.

6. Scroll compressor according to claim 2, wherein the stationary disk comprises the stationary spiral, which is arranged on a stationary base of the stationary disk and forms a spiral-shaped compressor channel, characterized in that the orifice opening of the direct oil return
either is disposed at a position angle in a range of $\gamma-30°$ and $\gamma+30°$, where $\gamma$ is a position angle of an outer end of the compressor channel, and is disposed at a radial distance $R_{M,1}$ from a center of the stationary disk, where $R_{M,1}$ is in a range between $(R_I(\gamma)-B_K)$ and $R_I(\gamma)$, where $R_I(\gamma)$ is a radial distance of an inner side of the stationary spiral at an outer end of the compressor channel, and $B_K$ is a width of the compressor channel along the radial direction at the outer end of the compressor channel,
or outside the stationary spiral and at a position angle in the range of $\theta-30°$ to $\theta+30°$, and at a radial distance $R_{M,2}$ from the center of the stationary disk (20), where $\theta=\gamma+180°$, and $R_{M,2}$ is in a range of $R_A(\theta-360°)$ to $R_A(\theta-360°)+B_K$, where $R_A(\theta-360°)$ is a radial distance of an outer side of the stationary spiral at the position angle $\theta-360°$.

7. Scroll compressor according to claim 2, wherein during compression operation at least one compression chamber is formed between the orbiting spiral and the stationary spiral, characterized in that the at least one orifice opening is not swept by any compression chamber at any time.

8. Scroll compressor according to claim 1, wherein the stationary disk comprises the stationary spiral, which is arranged on a stationary base of the stationary disk and forms a spiral-shaped compressor channel, characterized in that the orifice opening of the direct oil return
either is disposed at a position angle in a range of $\gamma-30°$ and $\gamma+30°$, where $\gamma$ is a position angle of an outer end of the compressor channel, and is disposed at a radial distance $R_{M,1}$ from a center of the stationary disk, where $R_{M,1}$ is in a range between $(R_I(\gamma)-B_K)$ and $R_I(\gamma)$, where $R_I(\gamma)$ is a radial distance of an inner side of the stationary spiral at an outer end of the compressor channel, and $B_K$ is a width of the compressor channel along the radial direction at the outer end of the compressor channel, or outside the stationary spiral and at a position angle in the range of $\theta-30°$ to $\theta+30°$, and at a radial distance $R_{M,2}$ from the center of the stationary disk (20), where $\theta=\gamma+180°$, and $R_{M,2}$ is in a range of $R_A(\theta-360°)$ to $R_A(\theta-360°)+B_K$, where $R_A(\theta-360°)$ is a radial distance of an outer side of the stationary spiral at the position angle $\theta-360°$.

9. Scroll compressor according to claim 4, wherein during compression operation at least one compression chamber is formed between the orbiting spiral and the stationary spiral, characterized in that the at least one orifice opening is not swept by any compression chamber at any time.

10. Scroll compressor according to claim 1, wherein during compression operation at least one compression chamber is formed between the orbiting spiral and the stationary spiral, characterized in that the at least one orifice opening is not swept by any compression chamber at any time.

11. Scroll compressor according to claim 1, characterized in that the direct oil return comprises a second flow valve arranged after of the outgassing chamber.

12. Scroll compressor according to claim 1, characterized in that the scroll compressor is configured such that, during compression operation, an intermediate pressure in the outgassing chamber is in a range from 0.2 bar to 6 bar above an intake pressure of the compression section.

13. Scroll compressor according to claim 1, characterized in that the scroll compressor has an outlet pressure chamber, the oil separator being in direct fluid communication with the outlet of the compression section via the outlet pressure chamber.

14. Scroll compressor according to claim 13, characterized in that the outgassing chamber is formed radially outside the outlet pressure chamber and surrounds the outlet pressure chamber.

15. Scroll compressor according to claim 1, characterized in that the scroll compressor further comprises:

a contact pressure chamber to which a contact pressure is applied during compression operation, wherein the orbiting disk is pressed against the stationary disk by the contact pressure; and a second oil return for returning oil from the oil separator to the contact pressure chamber.

16. Scroll compressor according to claim 15, characterized in that the second oil return has priority over the direct oil return in case of oil shortage.

17. Scroll compressor according to claim 10, characterized in that the direct oil return has a first oil inlet opening into the oil separator, and that the second oil return has a second oil inlet opening into the oil separator, the first oil inlet being arranged above the second oil inlet.

18. Scroll compressor according to claim 15, characterized in that the scroll compressor comprises a reference opening, arranged in the compression section, and a reference connection forming a fluid connection between the contact pressure chamber and the reference opening for influencing the contact pressure by means of a reference pressure applied to the reference opening during operation.

19. Scroll compressor according to claim 1, characterized in that the outgassing chamber has a volume in the range from 30 $cm^3$ to 150 $cm^3$.

20. Scroll compressor according to claim 1, characterized in that an orifice opening of the fluid return is arranged in a central portion of a compressor channel of the stationary disk, the central portion of the compressor channel being composed of all portions of the compressor channel that cannot be in direct fluid communication either with the inlet of the compression section or with the outlet of the compression section.

* * * * *